US012006803B2

(12) United States Patent
Whyte et al.

(10) Patent No.: US 12,006,803 B2
(45) Date of Patent: Jun. 11, 2024

(54) SYSTEMS AND METHODS FOR PRODUCING HYDROCARBON MATERIAL FROM UNCONSOLIDATED FORMATIONS

(71) Applicants: NCS MULTISTAGE INC., Calgary (CA); NCS MULTISTAGE, LLC, Houston, TX (US)

(72) Inventors: Rio Whyte, Calgary (CA); Doug Brunskill, Calgary (CA); Kurt Cooper, Houston, TX (US); David Wages, Anchorage, AK (US)

( * ) Notice: Subject to any disclaimer, the term of this patent is extended or adjusted under 35 U.S.C. 154(b) by 0 days.

(21) Appl. No.: 17/789,253

(22) PCT Filed: Dec. 24, 2020

(86) PCT No.: PCT/CA2020/051803

§ 371 (c)(1),
(2) Date: Jun. 27, 2022

(87) PCT Pub. No.: WO2021/127789

PCT Pub. Date: Jul. 1, 2021

(65) Prior Publication Data

US 2023/0050639 A1 Feb. 16, 2023

Related U.S. Application Data

(60) Provisional application No. 62/954,222, filed on Dec. 27, 2019.

(51) Int. Cl.

| | |
|---|---|
| ***E21B 34/14*** | (2006.01) |
| ***E21B 43/12*** | (2006.01) |
| ***E21B 43/26*** | (2006.01) |

(52) U.S. Cl.

CPC ..... *E21B 43/12* (2013.01); *E21B 34/14* (2013.01); *E21B 43/26* (2013.01); *E21B 2200/06* (2020.05)

(58) Field of Classification Search

CPC ..... E21B 43/04; E21B 43/08; E21B 43/12; E21B 2200/06; E21B 34/125; E21B 34/14

See application file for complete search history.

(56) References Cited

U.S. PATENT DOCUMENTS

| | | | | |
|---|---|---|---|---|
| 6,886,634 | B2 * | 5/2005 | Richards | E21B 43/088 166/227 |
| 6,938,698 | B2 * | 9/2005 | Coronado | E21B 33/127 166/387 |

(Continued)

FOREIGN PATENT DOCUMENTS

| | | | |
|---|---|---|---|
| EP | 3138993 | B1 | 1/2021 |
| WO | 2016172791 | A1 | 11/2016 |
| WO | 2018161170 | A1 | 9/2018 |

*Primary Examiner* — Kenneth L Thompson
(74) *Attorney, Agent, or Firm* — Sheridan Ross P.C.

(57) ABSTRACT

A wellbore material transfer system is disclosed, and comprises a downhole fluid conductor defining a downhole-conducting fluid passage, an uphole fluid conductor defining an uphole-conducting fluid passage, a flow controller for opening and closing the uphole-conducting fluid passage, and a completion disposed within a wellbore and defining a wellbore interval between the completion and the wellbore, the completion including selectively openable first and second flow communicators. While the flow communicators are open and the uphole-conducting fluid passage is closed, a subterranean formation zone may be fractured, and flow communication is absent, via the second flow communicator and the uphole-conducting fluid passage, between the wellbore interval and the surface. While the flow communicators and the uphole-conducting fluid passage are open, the wellbore interval may be gravel packed, and a solids-depleted fluid is conductible, via the second flow communicator and the uphole-conducting fluid passage, from the wellbore interval to the surface.

10 Claims, 26 Drawing Sheets

(56) References Cited

U.S. PATENT DOCUMENTS

| | | | | |
|---|---|---|---|---|
| 7,096,945 | B2 * | 8/2006 | Richards | E21B 34/103 166/276 |
| 8,047,298 | B2 * | 11/2011 | Solhaug | E21B 41/00 166/387 |
| 8,291,985 | B2 * | 10/2012 | Holderman | E21B 41/00 166/376 |
| 8,757,252 | B2 * | 6/2014 | Franklin | E21B 34/066 166/205 |
| 9,580,993 | B2 * | 2/2017 | Aitken | E21B 43/084 |
| 9,725,984 | B2 * | 8/2017 | Fripp | E21B 34/08 |
| 9,732,588 | B2 | 8/2017 | Fripp et al. | |
| 10,294,752 | B2 * | 5/2019 | Roessler | E21B 34/14 |
| 10,458,195 | B2 | 10/2019 | Johnson et al. | |
| 10,890,057 | B2 * | 1/2021 | MacPhail | E21B 17/1035 |
| 11,142,997 | B2 * | 10/2021 | Akkerman | E21B 43/14 |

* cited by examiner

SYSTEMS AND METHODS FOR PRODUCING HYDROCARBON MATERIAL FROM UNCONSOLIDATED FORMATIONS

FIELD

The present disclosure relates to systems and methods for producing hydrocarbon material from a subterranean formation, and, in particular, systems and methods for hydraulically fracturing a subterranean zone corresponding to a wellbore interval, gravel packing the wellbore interval, and producing, via the gravel pack, from the subterranean formation.

BACKGROUND

Production of hydrocarbon reservoirs is complicated by the presence of solid particulate matter that is entrained within the produced fluid. Such solid particulate matter includes naturally-occurring solids debris, such as sand. It also includes solids, such as proppant, which have been intentionally injected into the reservoir, in conjunction with treatment fluid, for improving the rate of hydrocarbon production from the reservoir. The entrained solids can complicate operations by causing erosion and interfering with fluid flow. To control sand production, screened frac sleeves are employed within wellbore completions. An exemplary technology including screened frac sleeves, and methods employing such technology, is disclosed in International Patent Publication No. WO2018161170A1.

SUMMARY

In one aspect, there is provided a wellbore material transfer system for transferring material between the surface and a subterranean formation, comprising: a downhole fluid conductor extending from the surface and into the subterranean formation, and defining a downhole-conducting fluid passage; an uphole fluid conductor extending from the surface and into the subterranean formation, and defining an uphole-conducting fluid passage; an uphole-conducting fluid flow controller for opening and closing the uphole-conducting fluid passage; a completion including a flow control apparatus that includes a selectively openable first flow communicator and a selectively openable second flow communicator; wherein: the completion is disposed within a wellbore such that a wellbore interval is defined between the completion and the wellbore; the first flow communicator is for effecting flow communication between the downhole-conducting fluid passage and the wellbore interval; the second flow communicator is defined by a flow communicating filtering medium; the second flow communicator is for effecting flow communication between wellbore interval and the downhole-conducting fluid passage; the flow control apparatus is configurable in a production-readying configuration; in the production-readying configuration, each one of the first flow communicator and the second flow communicator, independently, is disposed in an open condition; while the flow control apparatus is disposed in the production-readying configuration, and the uphole-conducting fluid passage is closed by the uphole-conducting fluid flow controller: stimulation material is conductible, via the downhole-conducting fluid passage and the first flow communicator, to the wellbore interval, with effect that hydraulic fracturing of a zone of the subterranean formation, corresponding to the wellbore interval, is effected; and there is an absence of flow communication, via the second flow communicator and the uphole-conducting fluid passage, between the wellbore interval and the surface; and while the flow control apparatus is disposed in the production-readying configuration, and the uphole-conducting fluid passage is disposed in an open condition: gravel slurry material is conductible, via the downhole-conducting fluid passage and the first flow communicator, to the wellbore interval, with effect that gravel packing of the wellbore interval is effected; and a solids-depleted fluid is conductible, via the second flow communicator and the uphole-conducting fluid passage, from the wellbore interval to the surface.

In another aspect, there is provided a wellbore material transfer system for transferring material between the surface and a subterranean formation, comprising: a wellbore string disposed within a wellbore, extending into the subterranean formation, such that an intermediate wellbore space is defined between the wellbore string and the wellbore; a completion continuous with the wellbore string, wherein the completion includes: a flow control apparatus including: a housing; an apparatus passage defined within the housing; a first flow communicator, extending through the housing, for effecting flow communication between the apparatus passage and an intermediate wellbore space interval portion of the intermediate wellbore space; and a second flow communicator, extending through the housing, for effecting flow communication between the apparatus passage and the intermediate wellbore space interval portion; wherein: the first flow communicator is disposed in flow communication with the second flow communicator via the intermediate wellbore space interval portion; and the second flow communicator is defined by a flow communicating filtering medium; an uphole fluid-conducting tool string disposed within a wellbore string space of the wellbore string such that a downhole-conducting fluid passage is defined between the uphole fluid conducting tool string and the wellbore string, wherein the uphole fluid-conducting tool string defines an uphole-conducting fluid passage; an uphole-conducting fluid flow controller for controlling flow through the uphole-conducting fluid passage; an uphole-disposed completion-defined sealed interface, established by an uphole-disposed completion portion of the completion, that is disposed uphole relative to the first flow communicator, for preventing material, disposed within the downhole-conducting fluid passage and uphole relative to the first flow communicator, from being conducted externally of the wellbore string; a downhole-conducting fluid passage sealed interface, established within the downhole-conducting fluid passage and downhole relative to the first flow communicator, for preventing material, disposed uphole relative to the downhole-conducting fluid passage sealed interface, from being conducted downhole, relative to the downhole-conducting fluid passage sealed interface, via the downhole-conducting fluid passage, and is also for preventing material, disposed downhole relative to the downhole-conducting fluid passage sealed interface, from being conducted uphole, relative to the downhole-conducting fluid passage sealed interface, via the downhole-conducting fluid passage; an uphole intermediate wellbore space sealed interface, established within the intermediate wellbore space and uphole relative to the first flow communicator, for preventing material, disposed within the intermediate wellbore space interval portion, from being conducted uphole, relative to the uphole intermediate wellbore space sealed interface, via the intermediate wellbore space; a downhole intermediate wellbore space sealed interface, established within the intermediate wellbore space and downhole relative to the second flow communicator, for preventing material disposed within the intermediate wellbore space interval portion from being conducted downhole, relative to the downhole intermediate wellbore space sealed interface, via the intermediate wellbore space; and a downhole-disposed completion-defined sealed interface, established by a downhole-disposed completion portion of the completion that is disposed downhole relative to the second flow communicator, for preventing material disposed within the wellbore string space, downhole relative to the second flow communicator, from being conducted externally of the wellbore string; wherein: the flow control apparatus is configurable in a production-readying configuration, wherein, in the production-readying configuration, each one of the first and second flow communicators independently, is disposed in an open condition; the completion, the uphole fluid conducting tool string, the downhole-conducting fluid passage sealed interface, the uphole intermediate wellbore space sealed interface, and the downhole intermediate wellbore space sealed interface are co-operatively configurable for disposition in a downhole material supplying configuration within the wellbore; in the downhole material-supplying configuration: (i) the flow control apparatus is disposed in the production-readying configuration, (ii) flow communication is established, via the first flow communicator, between the downhole-conducting fluid passage and the intermediate wellbore space interval portion, (iii) flow communication is established, via the second flow communicator, between the intermediate wellbore space interval portion and the uphole-conducting fluid passage, (iii) the portion of the completion, disposed uphole relative to the first flow communicator, defines an uphole-disposed completion-defined sealed interface for preventing material disposed within the downhole-conducting fluid passage, uphole relative to the first flow communicator, from being conducted externally of the wellbore string, (iv) the uphole-disposed completion-defined sealed interface and the downhole-conducting fluid passage sealed interface co-operate for preventing material, being conducted downhole via the downhole-conducting fluid passage, from bypassing the first flow communicator, (v) the uphole intermediate wellbore space sealed interface is disposed for preventing material, being conducted via the first flow communicator, from the downhole-conducting fluid passage and into the intermediate wellbore space interval portion, from being conducted uphole, relative to the uphole intermediate wellbore space sealed interface, via the intermediate wellbore space, (vi) the downhole intermediate wellbore space sealed interface is disposed for preventing material, being conducted via the first flow communicator, from the downhole-conducting fluid passage and into the intermediate wellbore space, from being conducted downhole, relative to the downhole intermediate wellbore space sealed interface, via the intermediate wellbore space, (vii) the portion of the completion, disposed downhole relative to the second flow communicator, defines a downhole-disposed completion-defined sealed interface for preventing material disposed within the wellbore string space, downhole relative to the second flow communicator, from being conducted externally of the wellbore string, (viii) the downhole-conducting fluid passage sealed interface and the downhole-disposed completion-defined sealed interface co-operate such that material being conducted, via the second flow communicator, from the intermediate wellbore space and into the apparatus passage, is prevented from bypassing the uphole-conducting fluid passage; while the completion, the uphole fluid conducting tool string, the downhole-conducting fluid passage sealed interface, the uphole intermediate wellbore space sealed interface, and the downhole intermediate wellbore space sealed interface are co-operatively disposed in the downhole material supplying configuration, and the uphole-conducting fluid flow controller is disposed in a closed condition, a stimulation material is injectable through the downhole-conducting fluid passage and into the intermediate wellbore space interval portion, via the first flow communicator, for effecting hydraulic fracturing of a corresponding zone of the subterranean formation; and while the completion, the uphole fluid conducting tool string, the downhole-conducting fluid passage sealed interface, the uphole intermediate wellbore space sealed interface, and the downhole intermediate wellbore space sealed interface are co-operatively disposed in the downhole material supplying configuration, and the uphole-conducting fluid flow controller is disposed in an open condition, a gravel pack slurry is injectable through the downhole-conducting fluid passage and into the intermediate wellbore space interval portion, via the first flow communicator, for effecting gravel packing of the intermediate wellbore space interval portion.

In another aspect, there is provided a method of at least conditioning a subterranean formation for production of hydrocarbon material, comprising: over a first time interval, while: (i) a wellbore interval is disposed in flow communication, via a first flow communicator of a downhole flow control apparatus, with a downhole-conducting fluid passage that extends from the surface and into the subterranean formation, and is also disposed in flow communication, via a second flow communicator of the downhole flow control apparatus, with an uphole-conducting fluid passage that extends from the surface and into the subterranean formation, and (ii) an uphole-conducting fluid flow controller is disposed in a closed condition such that the uphole-conducting fluid passage is closed, with effect that there is an absence of flow communication, via the uphole-conducting fluid passage, between the wellbore interval and the surface: supplying a stimulation material to the wellbore interval, via the downhole-conducting fluid passage and the first flow communicator, with effect that stimulation of a zone of the subterranean formation, corresponding to the wellbore interval, for hydrocarbon production is effected, such that a stimulation phase is defined; after the first time interval, and over a second time interval, and while: (i) a wellbore interval is disposed in flow communication, via a first flow communicator of a downhole flow control apparatus, with a downhole-conducting fluid passage that extends from the surface and into the subterranean formation, and is also disposed in flow communication, via a second flow communicator of the downhole flow control apparatus, with an uphole-conducting fluid passage that extends from the surface and into the subterranean formation, and (ii) the uphole-conducting fluid flow controller is disposed in an open condition such that the uphole-conducting fluid passage is open, with effect that flow communication, via the uphole-conducting fluid passage, between the wellbore interval and the surface is effected: supplying a slurry material to the wellbore interval, via the downhole-conducting fluid passage and the first flow communicator, with effect that gravel packing of the wellbore interval is effected, and a solids-depleted fluid is conducted to the surface via the second flow communicator and the open uphole-conducting fluid passage, such that a gravel packing phase is defined; wherein: the second flow communicator is defined by a flow communicating filter medium.

In another aspect, there is provided a method of at least conditioning a subterranean formation for production of hydrocarbon material, comprising: over a first time interval, and while: (i) a wellbore interval is disposed in flow communication, via a first flow communicator of a downhole flow control apparatus, with a downhole-conducting fluid passage that extends from the surface and into the subterranean formation, and is also disposed in flow communication, via a second flow communicator of the downhole flow control apparatus, with an uphole-conducting fluid passage that extends from the surface and into the subterranean formation, and (ii) an uphole-conducting fluid flow controller is disposed in an open condition such that the uphole-conducting fluid passage is open, with effect that flow communication, via the uphole-conducting fluid passage, between the wellbore interval and the surface is effected: supplying a slurry material to the wellbore interval, via the downhole-conducting fluid passage and the first flow communicator, with effect that gravel packing of the wellbore interval is effected, and a solids-depleted fluid is conducted to the surface via the second flow communicator and the open uphole-conducting fluid passage, such that a gravel packing phase is defined; over a second time interval, while: (i) a wellbore interval is disposed in flow communication, via a first flow communicator of a downhole flow control apparatus, with a downhole-conducting fluid passage that extends from the surface and into the subterranean formation, and is also disposed in flow communication, via a second flow communicator of the downhole flow control apparatus, with an uphole-conducting fluid passage that extends from the surface and into the subterranean formation, and (ii) an uphole-conducting fluid flow controller is disposed in a closed condition such that the uphole-conducting fluid passage is closed, with effect that there is an absence of flow communication, via the uphole-conducting fluid passage, between the wellbore interval and the surface: supplying a stimulation material to the wellbore interval, via the downhole-conducting fluid passage and the first flow communicator, with effect that stimulation of a zone of the subterranean formation, corresponding to the wellbore interval, for hydrocarbon production is effected, such that a stimulation phase is defined; wherein: the second flow communicator is defined by a flow communicating filter medium.

In another aspect, there is provided a wellbore completion component, defining a transition impeder, comprising: a housing; and a completion component feature configurable in a first configuration and a second configuration; wherein: the transition impeder includes: a transition-impeding fluid passage; and a fluid disposed for flow within the transition-impeding fluid passage; the flow of the fluid, through the transition-impeding fluid passage, is effected in response to the transitioning of the completion component feature from the first configuration to the second configuration; and the transition impeder and the completion component feature are co-operatively configured such that resistance to flow, of the fluid through the transition-impeding fluid passage, impedes the transitioning of the completion component feature from the first configuration to the second configuration.

In another aspect, there is provided a method of modulating a flow communication state of a downhole flow control apparatus, wherein: the downhole flow control apparatus includes a flow communicator and a flow controller for controlling flow communication via the flow communicator; the flow control apparatus is configurable in at least a first flow communication configuration, a second flow communication configuration, and a third flow communication configuration; transitioning from the first flow configuration to the second flow configuration is effected in response to displacement of the flow controller, relative to the flow communicator, in one of an uphole and downhole direction, with effect that modulation of flow communication, via the flow communicator, is effected; transitioning from the second flow configuration to the third flow configuration is effected in response to displacement of the flow controller, relative to the flow communicator, in the one of an uphole and downhole direction, with effect that modulation of flow communication, via the flow communicator, is effected; and the transitioning from the first configuration to the third configuration is effectible in the absence of a displacement of the flow controller, relative to the flow communicator, in the other one of an uphole and downhole direction.

In another aspect, there is provided a wellbore material transfer system for transferring material between the surface and a subterranean formation, comprising: a wellbore string disposed within a wellbore, extending into the subterranean formation, such that an intermediate wellbore space is defined between the wellbore string and the wellbore; a flow control apparatus, integrated within the wellbore string, and including: a housing; an apparatus passage defined within the housing; a first flow communicator, extending through the housing, for effecting flow communication between the apparatus passage and the intermediate wellbore space; and a second flow communicator, extending through the housing, for effecting flow communication between the apparatus passage and the intermediate wellbore space; wherein: the first flow communicator is disposed in flow communication with the second flow communicator via the intermediate wellbore space; and the second flow communicator is defined by a flow communicating filtering medium; and a flow controller for controlling the flow communication via the first and second flow communicators; a tool string, defining an uphole-conducting fluid passage, and configured for disposition within a wellbore string space of the wellbore string, wherein the tool string includes: a sealed interface effector; and a shifting tool; wherein: the flow control apparatus is configurable in a production-readying configuration, wherein, in the production-readying configuration, each one of the first and second flow communicators independently, is disposed in an open condition; the flow control apparatus is configurable in a production configuration, wherein, in the production configuration, the first flow communicator is closed by the flow controller; while the tool string is disposed within the wellbore string, the sealed interface effector is deployable to a sealing configuration for establishing a sealed interface between the tool string and the wellbore string; the flow control apparatus and the tool string are co-operatively configurable for disposition in a downhole material supplying configuration; in the downhole material-supplying configuration: (i) the tool string is disposed within the wellbore string such that a downhole-conducting fluid passage is defined between the tool string and the wellbore string; (ii) the sealed interface effector is deployed in the sealing configuration such that a sealed interface is established within the downhole-conducting fluid passage and downhole relative to the first flow communicator, for preventing material, being conducted downhole within the downhole-conducting fluid passage, from bypassing the first flow communicator, and also for preventing material, being conducted uphole within the apparatus, from bypassing the uphole-conducting fluid passage; (iii) the flow control apparatus is disposed in the production-readying configuration, (iv) flow communication is established, via the first flow communicator, between the downhole-conducting fluid passage and the intermediate wellbore space, (v) flow communication is established, via the second flow communicator, between the intermediate wellbore space and the apparatus passage; while the flow control apparatus and the tool string are co-operatively disposed in the downhole material supplying configuration, a stimulation material is injectable through the downhole-conducting fluid passage and into the intermediate wellbore space, via the first flow communicator, for effecting hydraulic fracturing of a corresponding zone of the subterranean formation; and while the flow control apparatus and the tool string are co-operatively disposed in the downhole material supplying configuration, a gravel pack slurry is injectable through the downhole-conducting fluid passage and into the intermediate wellbore space interval portion, via the first flow communicator, for effecting gravel packing of the intermediate wellbore space interval portion; and the flow control apparatus is transitionable from the production-readying configuration to the production configuration in response to displacement of the flow controller by the shifting tool.

Other aspects will be apparent from the description and drawings provided herein.

BRIEF DESCRIPTION OF DRAWINGS

The embodiments will now be described with reference to the following accompanying drawings, in which.

DETAILED DESCRIPTION

Figure 1:
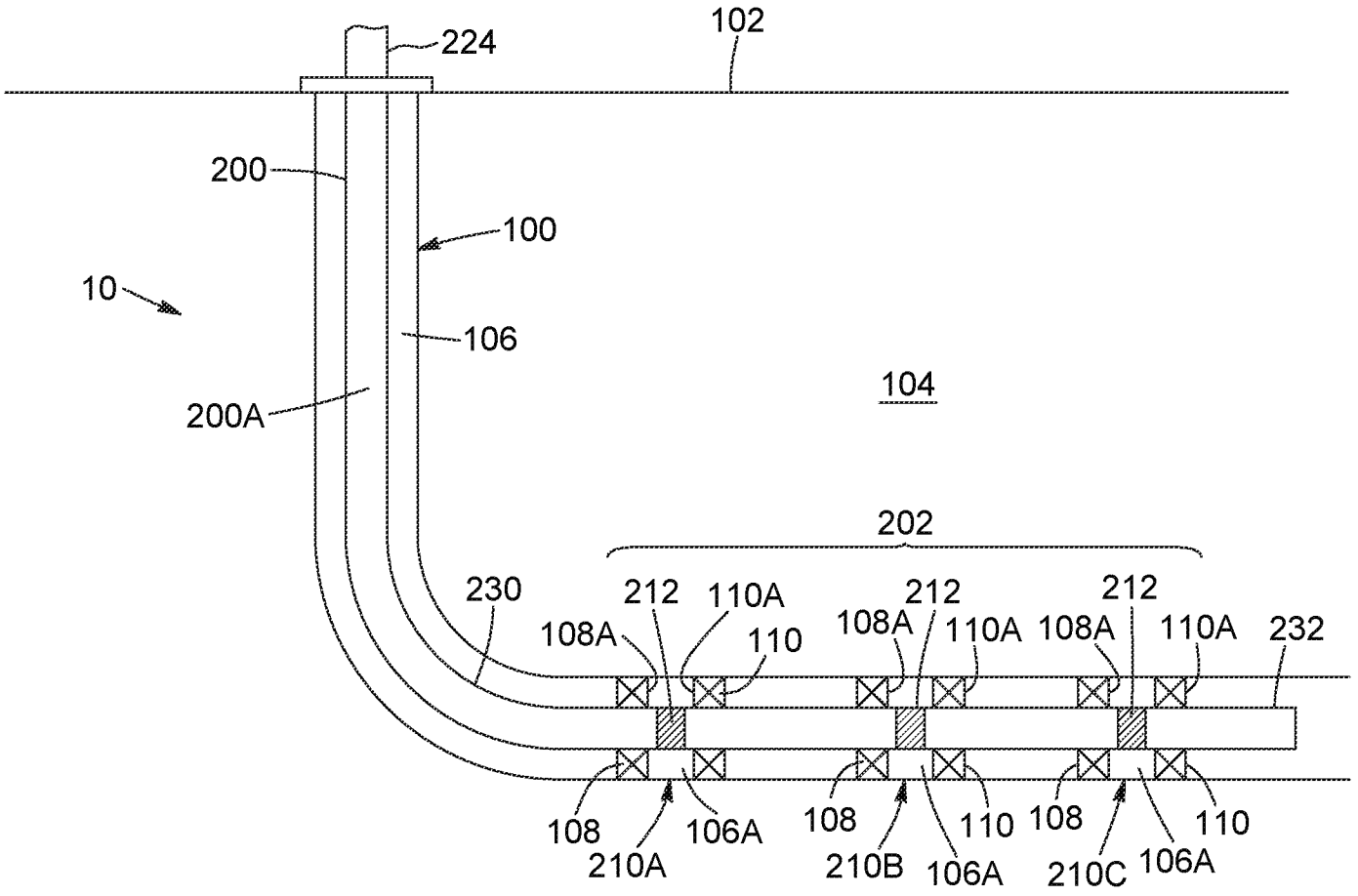
FIG. 1 is a schematic illustration of an embodiment of a system of the present disclosure.

There is provided a method of: (i) stimulating a zone of a subterranean formation 104 via a wellbore interval, and (ii) gravel packing the wellbore interval.

In some of these embodiments, for example, these operations are facilitated by an fluid conducting tool string 204 (such as, for example, a coiled tubing string) that is deployable through a wellbore string 200 disposed within a wellbore 100. The tool string 204 includes the shifting tool 228, for effecting displacement of a flow controller 222 for effecting flow communication with a wellbore interval 106 disposed between the wellbore string 200 and the subterranean formation 104, and which co-operates with a deployable sealed interface effector 205 for co-operatively diverting fluids during the stimulation and gravel packing operations.

In some of these embodiments, for example, the transitioning between the stimulating and the gravel packing corresponds to switching between closed and open conditions of a flow controller 224 disposed at the surface 102.

Additionally, a flow control apparatus 212 is provided which, while transitioning from a first configuration, which facilitates both of stimulation and gravel packing, to a second configuration, which facilitates production, becomes disposed in an intermediate configuration that seals downhole flow communication via the flow control apparatus 212. By providing such sealing of downhole flow communication, stimulation material and gravel slurry material can be directed to wellbore intervals corresponding to other zones of the subterranean formation for readying production of such zones. The establishing of the intermediate configuration is assisted by providing a transition impeder 300 for enabling detection, at the surface, of resistance to flow of a viscous fluid.

Referring to FIG. 1, the wellbore material transfer system 10 is provided for conducting material, within the wellbore 100, to and from the surface 102.

The wellbore 100 extends from the surface 102 and into the subterranean formation 104. In some embodiments, for example, the subterranean formation 104 includes a reservoir that contains hydrocarbon material.

The wellbore 100 can be straight, curved, or branched. The wellbore 100 can have various wellbore sections. A wellbore section is an axial length of the wellbore 100. A wellbore section can be characterized as "vertical" or "horizontal" even though the actual axial orientation can vary from true vertical or true horizontal, and even though the axial path can tend to "corkscrew" or otherwise vary. The term "horizontal", when used to describe a wellbore section, refers to a horizontal or highly deviated wellbore section as understood in the art, such as, for example, a wellbore section having a longitudinal axis that is between 70 and 110 degrees from vertical.

Figure 7:
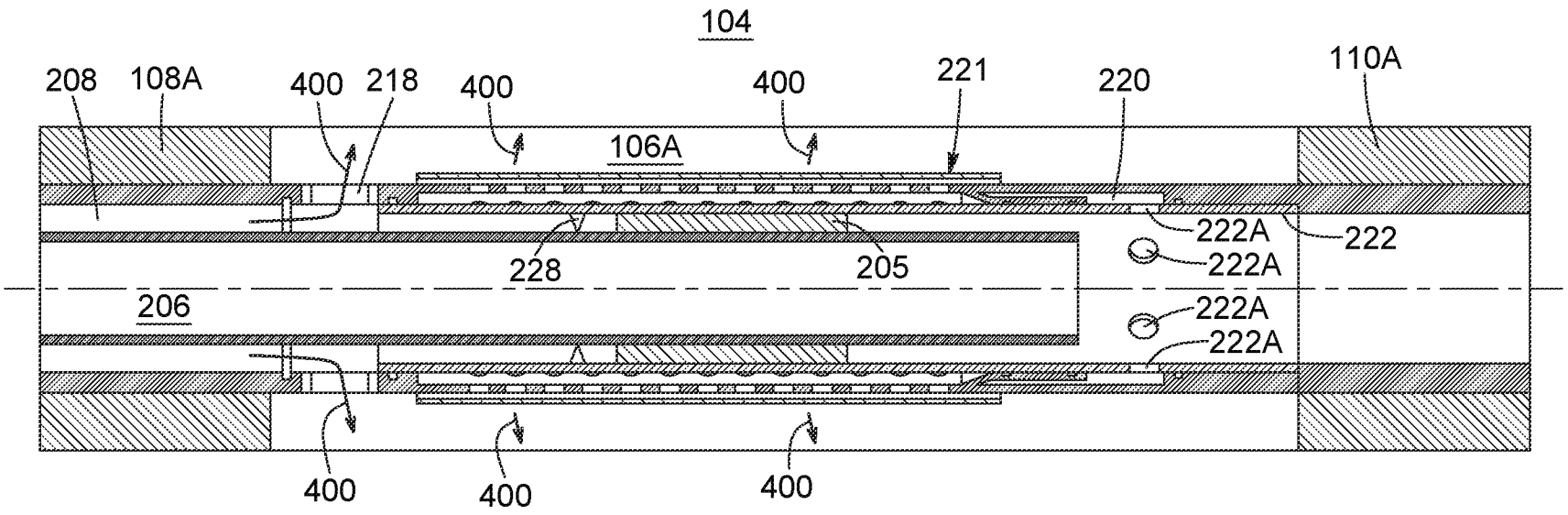
FIG. 7 is a schematic illustration of the system illustrated in FIG. 1, disposed in a downhole material supplying configuration, and illustrating injection of stimulation material into the subterranean formation.

Referring to FIG. 7, the system facilitates the conducting of stimulation material to the subterranean formation 104 via the wellbore 100, for effecting selective stimulation of the subterranean formation 104, such as a subterranean formation 104 including a hydrocarbon material-containing reservoir. The stimulation is effected by supplying the stimulation material to the subterranean formation 104. In some embodiments, for example, the stimulation material includes a liquid, such as a liquid including water. In some embodiments, for example, the liquid includes water and chemical additives. In other embodiments, for example, the stimulation material is a slurry including water and solid particulate matter, such as proppant. In some embodiments, for example the stimulation material includes chemical additives. Exemplary chemical additives include acids, sodium chloride, polyacrylamide, ethylene glycol, borate salts, sodium and potassium carbonates, glutaraldehyde, guar gum and other water-soluble gels, citric acid, and isopropanol. In some embodiments, for example, the stimulation material is supplied for effecting hydraulic fracturing of the subterranean formation 104.

Figure 12:
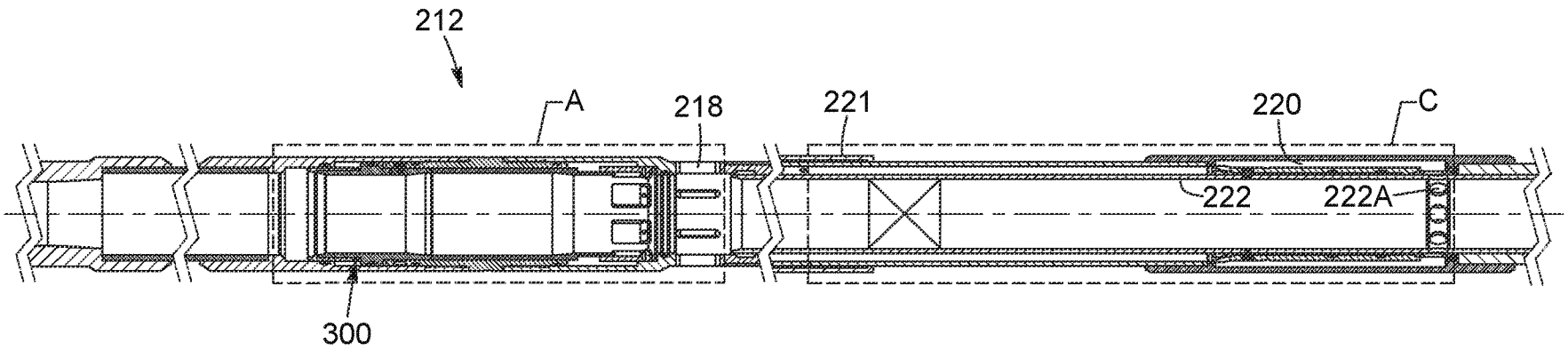
FIG. 12 is a sectional view of a flow control apparatus of the system illustrated in FIG. 1, disposed in the production-readying configuration, and illustrating the flowpath of return fluid produced during a gravel packing operation.
Figure 13:
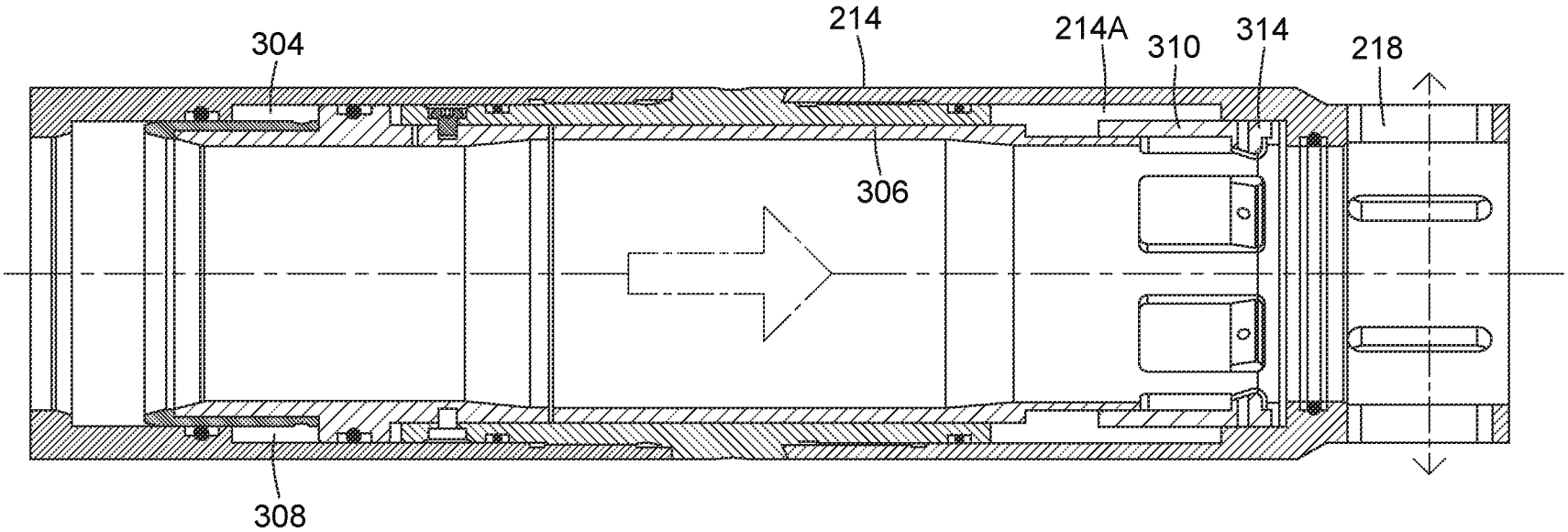
FIG. 13 is an enlarged view of Detail "A" in FIG. 12.
Figure 14:
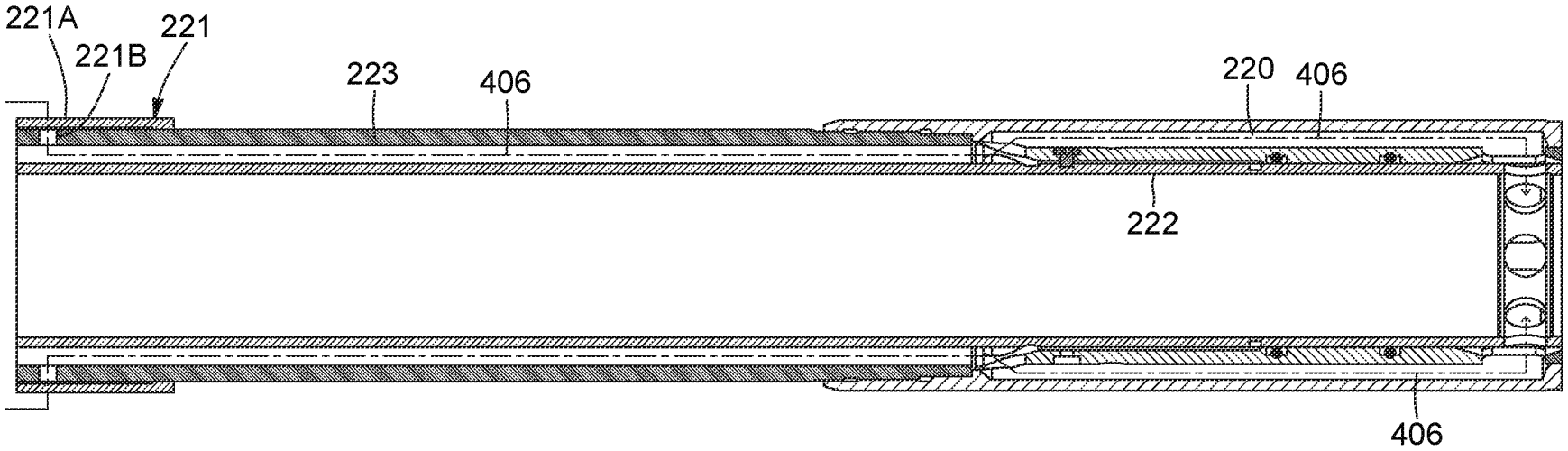
FIG. 14 is an enlarged view of Detail "C" in FIG. 12.
Figure 15:
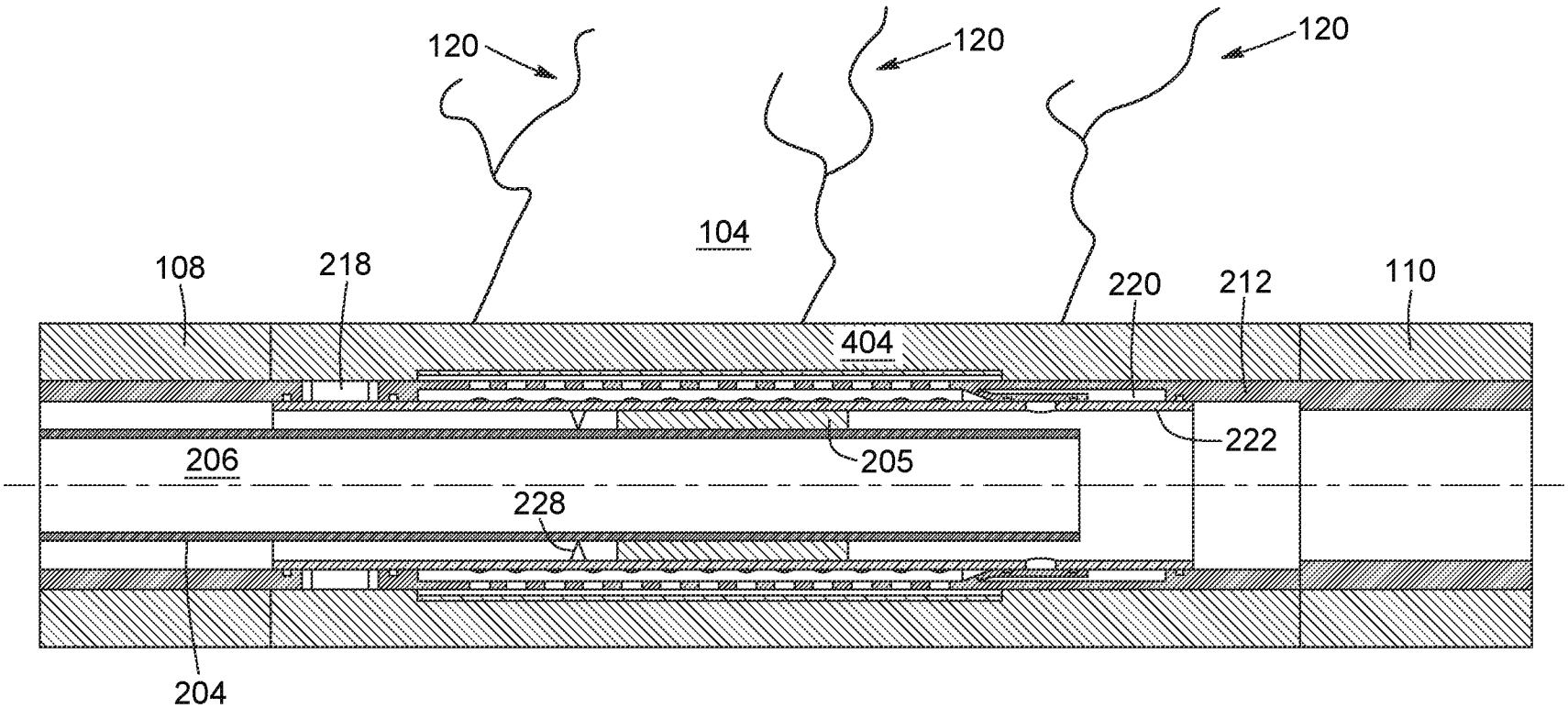
FIG. 15 is a schematic illustration of the system, with a flow control apparatus disposed in a intermediate closed configuration.
Figure 16:
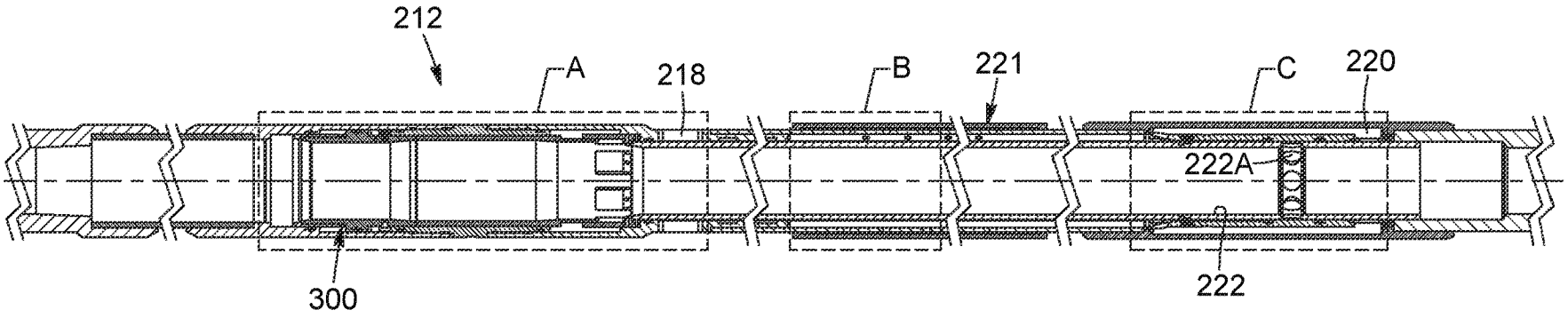
FIG. 16 is a sectional view of a flow control apparatus of the system illustrated in FIG. 1, disposed in the intermediate closed configuration.
Figure 17:
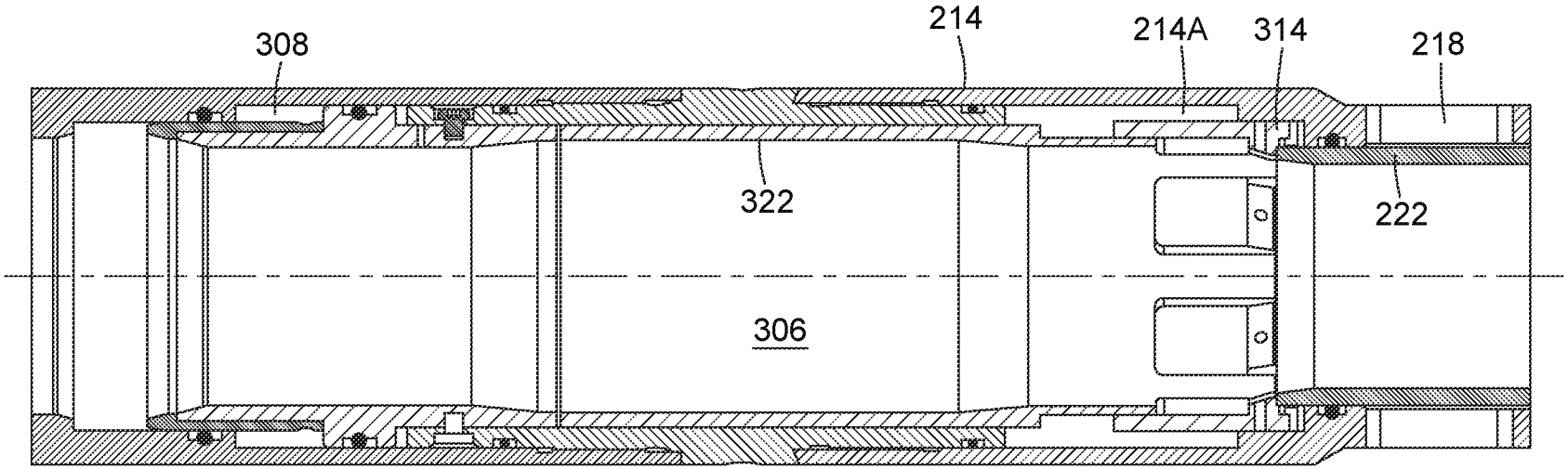
FIG. 17 is an enlarged view of Detail "A" in FIG. 16.
Figure 18:
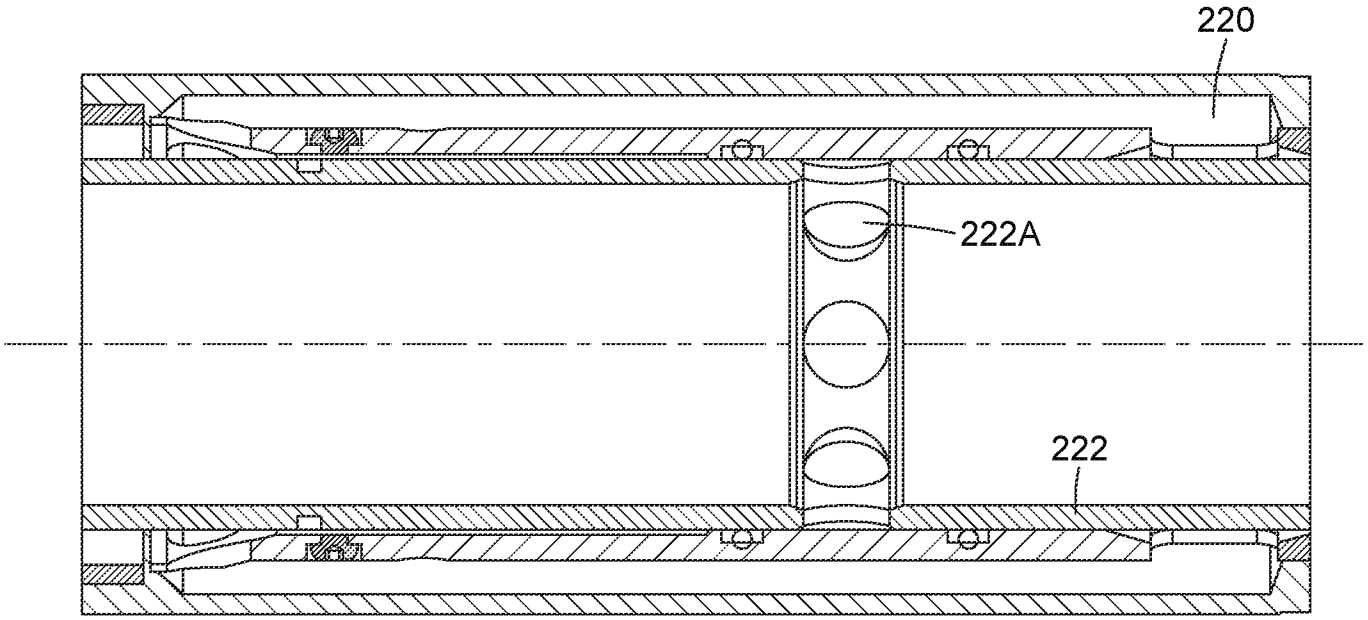
FIG. 18 is an enlarged view of Detail "C" in FIG. 16.

Referring to FIG. 12, the system also provides for the conducting of gravel slurry material to the subterranean formation 104 via the wellbore 100 is for gravel packing selective intervals of the wellbore 100. The gravel packing prevents production of sand along with hydrocarbon material that is being received from the subterranean formation 104. The gravel slurry material includes one or more of gravel, sand, and other solid particulate materials suspended in a fluid. In some embodiments, for example, the solid particulate material includes proppant.

The gravel packing results in deposition and accumulation, within the wellbore 100, of solid particulate materials that have been separated from the gravel slurry material, such that a solids-depleted fluid has been obtained. In this respect, the system enables the conducting of the solids-depleted fluid for effecting the return of the solids-depleted fluid to the surface as a return fluid.

Figure 19:
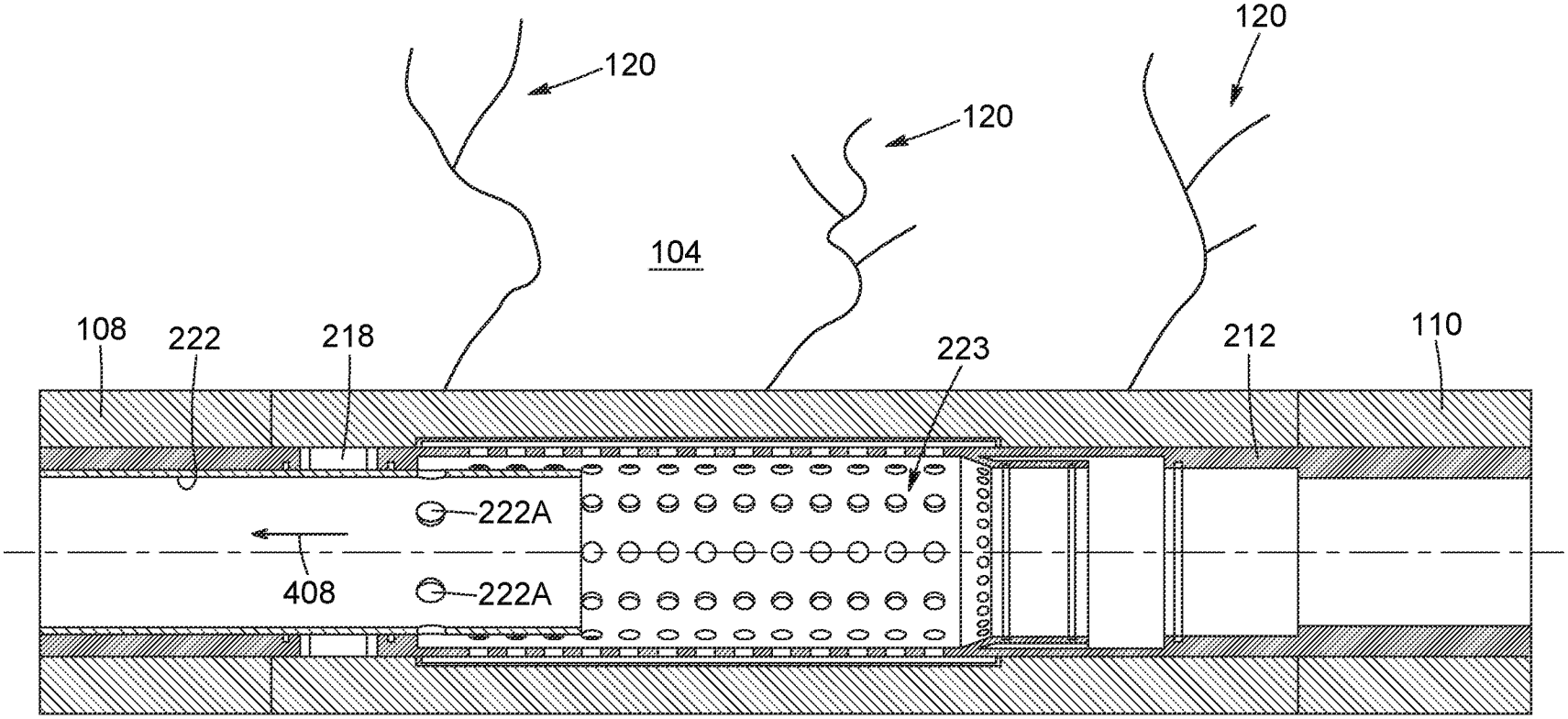
FIG. 19 is a schematic illustration of the system, with a flow control apparatus disposed in a production configuration.

Referring to FIG. 19, after the gravel packing, the system 10 also facilitates the conducting of hydrocarbon material, being produced from the subterranean formation, to the surface.

The conducting of fluids to and from the surface 102 is effected via a completion 202 of the wellbore string 200. The completion 202 is provided at a downhole end of the wellbore string 200 for effecting flow communication between the surface 102 and the subterranean formation 104. The completion 202 is deployable downhole with the wellbore string 200. An intermediate wellbore space 106 is defined between the wellbore string 200 and the wellbore 100 and provides space for establishing the gravel pack, as will be further explained below.

The wellbore string 200 may include pipe, casing, or liner, and may also include various forms of tubular segments. The wellbore string 200 defines a wellbore string space 200A. An fluid conducting tool string 204 is deployable within the wellbore string space 200A and defines an tool string-defined fluid passage 206, extending from the surface 102, for conducting material uphole to the surface 102. The disposition of the fluid conducting tool string 204 within the wellbore string space 200A is such that an intermediate passage is defined between fluid conducting tool string 204 and the wellbore string 200, and the intermediate passage functions as a annular fluid passage 208, extending from the surface, for conducting material downhole from the surface 102. In this respect, the wellbore string 200 is configured for conducting material, via the passages 206, 208 defined therein, between the surface 102 and the completion 202. In some embodiments, for example, the fluid conducting tool string 204 is a coiled tubing string.

In some embodiments, for example, flow through the tool string-defined fluid passage 206 is controllable via the uphole-conducting fluid flow controller 224. In some embodiments, for example, the uphole-conducting fluid flow controller 224 is disposed at the surface 102.

In some embodiments, for example, the wellbore 100 is completed open hole. In some embodiments, for example, the wellbore 100 is completed cased, and flow communication between the wellbore 100 and the subterranean formation 104 is effected via perforations, such as those formed by a plug and perf operation.

The completion 202 includes a plurality of flow control stations (three flow communication stations, 210A, 210B, 210C, are illustrated) for effecting the conducting of material between the surface 102 and the subterranean formation 104. Successive flow communication stations 210A, 210B, 210C may be spaced from each other along the wellbore 100 (such as, for example, with blank pipe) such that each one of the flow communication stations 210A, 210B, 210C, independently, is positioned adjacent a respective interval of the wellbore 100, for effecting flow communication between the surface 102 and a selected interval of the wellbore 100.

Each one of the flow communication stations 210A, 210B, 210C, independently, includes a respective flow control apparatus 212. In some embodiments, for example, the flow control apparatus 212 is in the form of a sub that is integratable within the wellbore string 200, such as, for example, by threaded coupling.

Figure 2:
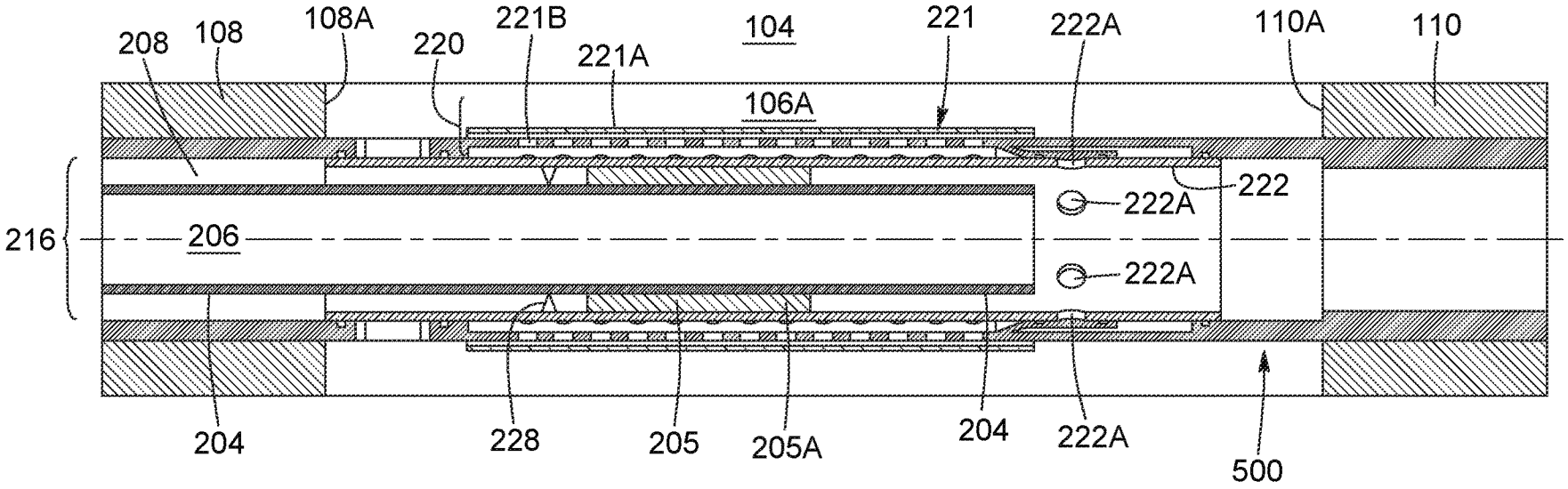
FIG. 2 is a schematic illustration of a flow control station disposed within a wellbore, with a corresponding flow control apparatus disposed in an installation configuration, and with an uphole fluid conducting string disposed within the apparatus passage of the flow control apparatus.
Figure 3:
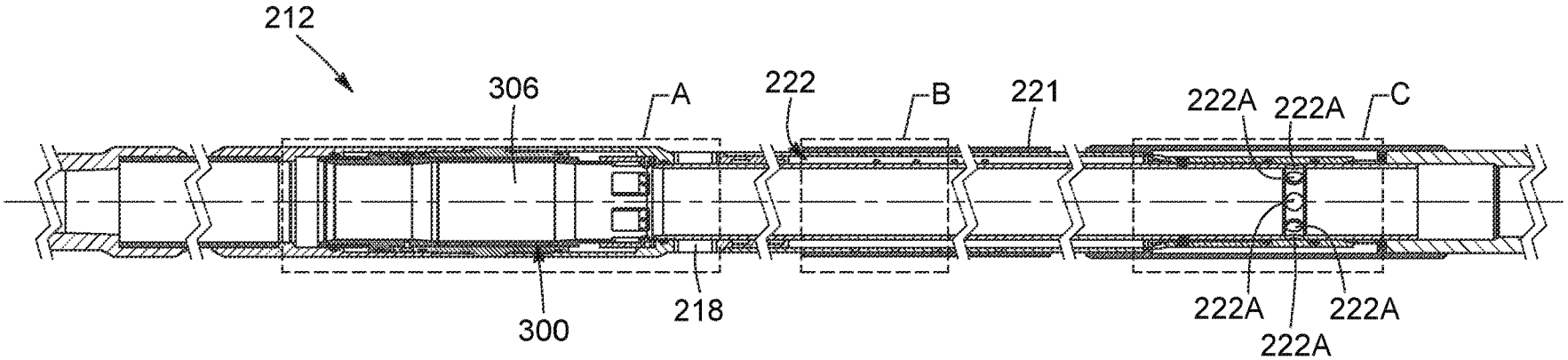
FIG. 3 is a sectional view of a flow control apparatus of the system illustrated in FIG. 1, disposed in the installation configuration.
Figure 4:
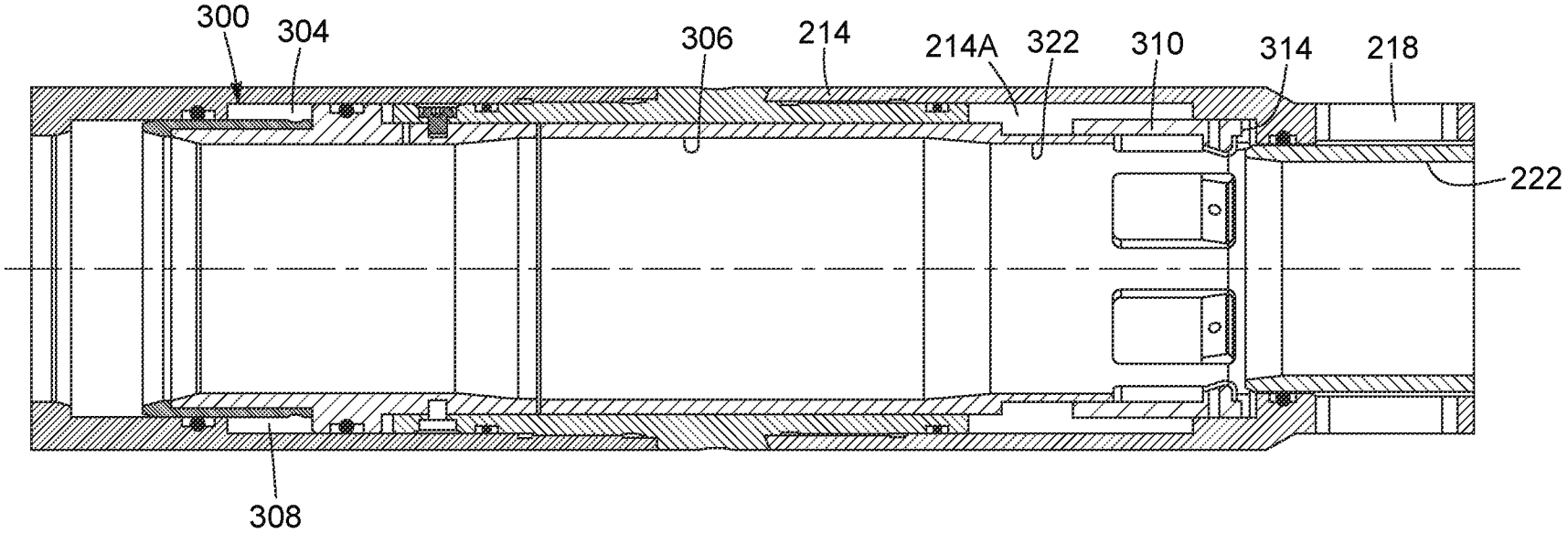
FIG. 4 is an enlarged view of Detail "A" in FIG. 3.
Figure 5:
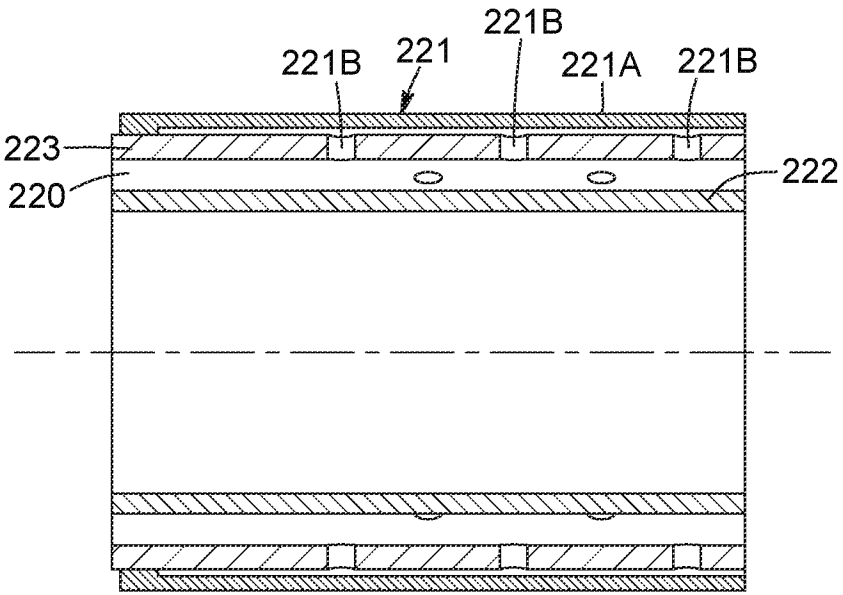
FIG. 5 is an enlarged view of Detail "B" in FIG. 3.
Figure 6:
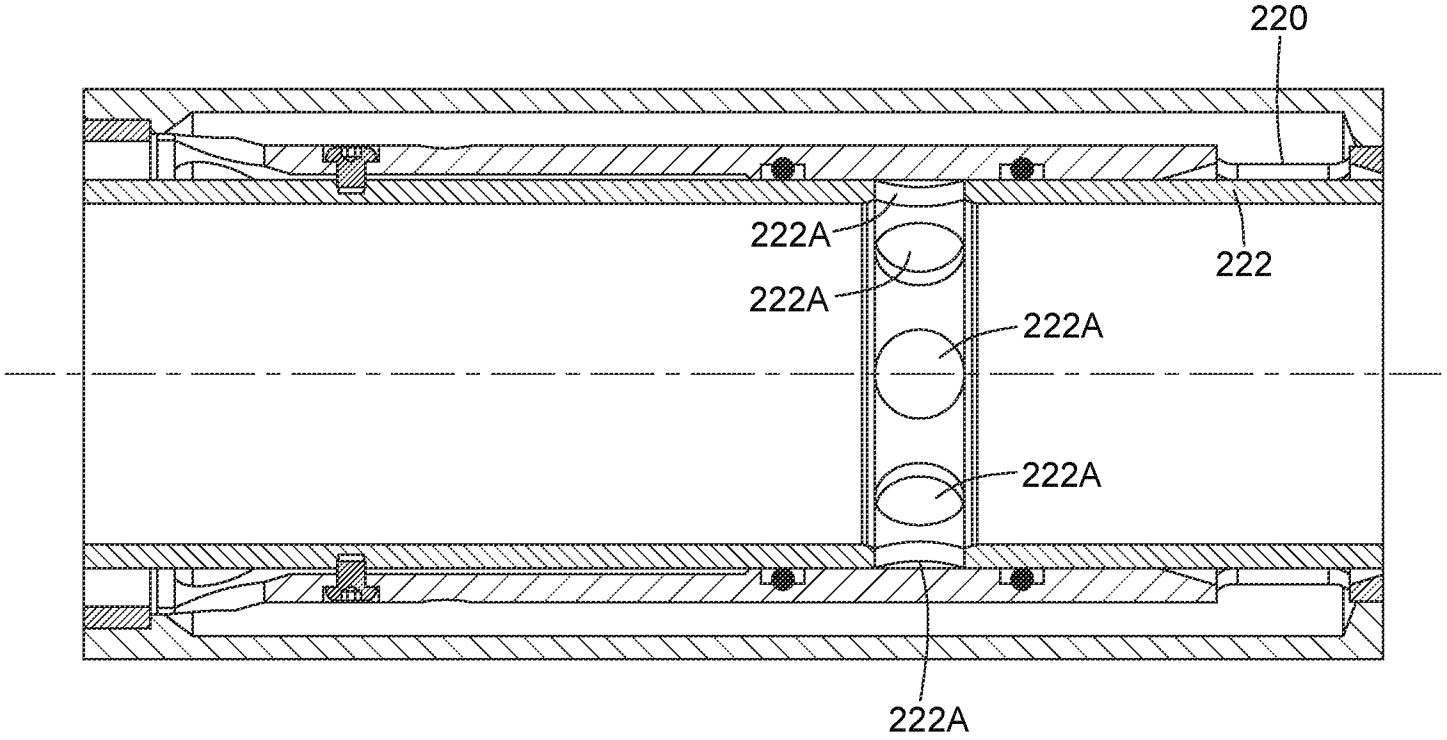
FIG. 6 is an enlarged view of Detail "C" in FIG. 3.

Referring to FIG. 2, the flow control apparatus 212 includes a housing 214. An apparatus passage 216 is defined within the housing 214 for receiving the deployed fluid conducting tool string 204. The apparatus passage 216 forms a portion of the wellbore string space 200A.

The flow control apparatus 212 is respective to a corresponding intermediate wellbore space interval portion 106A of the intermediate wellbore space 106. The flow control apparatus 212 includes a first flow communicator 218 for effecting flow communication between the wellbore string space 200A and the intermediate wellbore space interval portion 106A. The flow control apparatus 212 also includes a second flow communicator 220 for effecting flow communication between the wellbore string space 200A and the intermediate wellbore space interval portion 106A. In this respect, the first flow communicator 218 is disposed in flow communication with the second flow communicator 220 via the intermediate wellbore space interval portion 106A.

The intermediate wellbore space interval portion 106A is defined between an uphole wellbore spaced sealed interface 108A and a downhole intermediate wellbore space sealed interface 110A.

The uphole intermediate wellbore space sealed interface 108A is disposed within the intermediate wellbore space 106, uphole relative to the first flow communicator 218. The sealed interface 108A is established by a sealed interface effector 108. In some embodiments, for example, the sealed interface effector 108 includes a packer. The uphole wellbore space sealed interface 108A is for preventing material, disposed within the intermediate wellbore space interval portion 106A, from being conducted uphole, relative to the uphole intermediate wellbore space sealed interface 108A, via the intermediate wellbore space 106.

The downhole intermediate wellbore space sealed interface 110A is disposed within the intermediate wellbore space 106, downhole relative to the second flow communicator 220. The sealed interface 110A is established by a sealed interface effector 110. In some embodiments, for example, the sealed interface effector 110 includes a packer. The downhole wellbore space sealed interface 110A is for preventing material, disposed within the intermediate wellbore space interval portion 106A, from being conducted downhole, relative to the downhole intermediate wellbore space sealed interface 110A, via the intermediate wellbore space 106.

The first flow communicator 218 extends through the housing 214. In some embodiments, for example, the first flow communicator 218 is defined by a plurality of ports. In some embodiments, for example, the axes of the ports are disposed within the same cross-section of the flow control apparatus 212. The first flow communicator 218 is provided for effecting flow communication between the apparatus passage 216 and the intermediate wellbore space interval portion 106A. In this respect, the first flow communicator 218 functions to effect flow communication between the annular fluid passage 208 of the wellbore string 200 and the wellbore.

In this way, the first flow communicator 218 is configured for injecting solids-containing fluid material, delivered by the annular fluid passage 208, into the intermediate wellbore space interval portion 106A. An exemplary solids-containing fluid material being injected externally of the flow control apparatus 212 is the stimulation material for effecting hydraulic fracturing of the subterranean formation. Another exemplary solids-containing fluid material being injected externally of the flow control apparatus 212 is the gravel slurry material for gravel packing.

The second flow communicator 220 extends through the housing 214 and is disposed downhole relative to the first flow communicator 218. In some embodiments, for example, the second flow communicator 218 is defined by a plurality of ports. In some embodiments, for example, the axes of the ports are disposed within the same cross-section of the flow control apparatus 212. The second flow communicator 220 is provided for effecting flow communication between the apparatus passage 216 and a space that is external to the flow control apparatus 212. In this respect, the second flow communicator 220 functions to effect flow communication between the tool string-defined fluid passage 206 and the intermediate wellbore space interval portion 106A.

Unlike the first flow communicator 218, the second flow communicator 220 is configured such that the maximum size of solid particulate matter, that is conductible through the second flow communicator 220, is less than the maximum size of solid particulate matter conductible through the first flow communicator 218.

In this way, the second flow communicator 220 is configured for conducting fluid material, without oversize solids, from the intermediate wellbore space 106 to the tool string-defined fluid passage 206. An exemplary fluid receivable from the intermediate wellbore space 106, and being conducted through the second flow communicator 220, is the solids-depleted fluid obtained during gravel packing of an interval of the wellbore 100. In some embodiments, for example, the solids-depleted fluid is that which is obtained while gravel packing is being effectuated in response to the supplying of the gravel slurry material to the intermediate wellbore passage 106 via the corresponding first flow communicator 218. In this respect, during gravel packing, oversize solids, within the gravel slurry material, are prevented from passing through the second flow communicator 220, from the intermediate wellbore space 106 to the tool string-defined fluid passage 206, with effect that the oversize solids are filtered from the gravel slurry material, such that a residual solids-depleted fluid passed through the second flow communicator 220, from the intermediate wellbore space 106 to the tool string-defined fluid passage 206.

Another exemplary fluid receivable from the intermediate wellbore space interval portion 106A is hydrocarbon material that is produced from the subterranean formation 104.

In some embodiments, for example, the second flow communicator 220 is defined by a flow communicating filter medium 221. The filter medium 221 is configured for preventing oversize solid particulate matter from being conducted from the intermediate wellbore space 106 and into the tool string-defined fluid passage 206. In this respect, the filter medium 221 functions as a debris retention device. In some embodiments, for example, the filter medium is a screen (such as, for example, a wire wrap screen), and the flow communication is effected via apertures defined within the screen. In some embodiments, for example, the filter medium is defined by a sand screen 221A that is wrapped around a perforated section (defined by ports 221B) of a base pipe 223 (or perforated liner), the perforated section defining a plurality of apertures. In some embodiments, for example, the filter medium is in the form of a porous material that is integrated within an aperture of a base pipe. In some embodiments, for example, the second flow communicator 220 is configured for preventing passage of +100 mesh proppant from the intermediate wellbore space interval portion 106A and into the tool string-defined fluid passage 206. In some embodiments, for example, the first flow communicator 218 is configured for permitting passage of solid particulate matter (e.g. sand) that passes through a 3 mesh sieve. In some embodiments, for example, the first flow communicator 218 is configured for permitting passage of solid particulate matter that passes through a 3½ mesh sieve. In some embodiments, for example, the first flow communicator 218 is configured for permitting passage of passage of solid particulate matter that passes through a 4 mesh sieve. In some embodiments, for example, the first flow communicator 218 is defined by a plurality of ports and, for each one of the ports, independently, there is an absence of occlusion, of the port (such as, for example, an absence of occlusion by a filter medium). In some embodiments, for example, the second flow communicator 220 is defined by a screened frac sleeve.

The flow control apparatus 212 further includes a flow controller 222. In some embodiments, for example, the flow controller 222 is in the form of a sliding sleeve that is displaceable, relative to the housing 214, within the passage 216. The displacing is for controlling flow communication via the flow communicators 218, 220. In some embodiments, for example, the displacing of the flow controller 222 is effected by a shifting tool 228 that translates with the uphole fluid conducting string 204. In some embodiments, for example, the shifting tool 228 is in the form of mechanical slips.

Referring to FIGS. 2 to 6, in some embodiments, for example, when the flow control apparatus 212 is initially installed, the flow controller 222 is releasably retained relative to the housing 214 such that both of the flow communicators 218, 220 are disposed in the closed condition. In some embodiments, for example, the releasable retention is effected by one or more frangible members. A suitable applied force must be applied to the flow controller 222 to effect fracturing of the frangible members and thereby effect the release of the flow controller 222 from such retention.

In some embodiments, for example, the flow controller 222 is displaceable to various selected positions and, while disposed in these selected positions, the flow controller 222 is prevented from being inadvertently moved from these selected positions. In this respect, in some embodiments, for example, collet retainers are provided for preventing such inadvertent movement. An exemplary co-operative configuration of a flow controller and a collet retainer is described in U.S. patent application Ser. No. 14/830,507 which is incorporated by reference in its entirety herein.

The deployable sealed interface effector 205 is carried by the fluid conducting tool string 204. The sealed interface effector 205 is deployable with effect that a sealed interface 205A becomes established within the annular fluid passage 208, downhole relative to the first flow communicator 218. Such a sealed interface is provided for preventing material, disposed uphole relative to the downhole-conducting fluid passage sealed interface 205A, from being conducted downhole, relative to the downhole-conducting fluid passage sealed interface 205A, via the annular fluid passage 208. Such a sealed interface is also provided for preventing material, disposed downhole relative to the downhole-conducting fluid passage sealed interface 205A, from being conducted uphole, relative to the downhole-conducting fluid passage sealed interface 205A, via the annular fluid passage 208. In some embodiments, for example, the deployable sealed interface effector 205 includes a packer. In some embodiments, for example, the packer is swellable. In some embodiments, for example, the packer is mechanically actuatable. In some embodiments, for example, the sealed interface is established by sealing engagement of the sealed interface effector with the wellbore string 200, such as, for example, by sealing engagement to the flow controller 222 of the flow control apparatus 212 that is integrated within the wellbore string 200.

When it is desired to inject stimulation material into a zone of a subterranean formation 104 for effecting the hydraulic fracturing of such zone, and then subsequently gravel pack a corresponding interval of the wellbore 100, the fluid conducting tool string 204 is deployed through the wellbore string 200 such that the shifting tool 228 becomes suitably positioned, within the apparatus passage 216 of the flow control apparatus 212, for actuation into engagement with the flow controller 222 for displacing the flow controller 222 relative to the flow communicators 218, 200. Referring to FIG. 2, while suitably positioned, the shifting tool 228 is actuated, and becomes engaged to the flow controller 222. In parallel, the sealed interface effector 205 is deployed and becomes sealingly engaged to the flow controller 222 to define the sealed interface 205A. While the shifting tool 228 is engaged to the flow controller 222, a compressive force is applied to the fluid conducting tool string 204, from the surface 102, with effect that the flow controller 222 is released from retention (for example, the frangible members are fractured) and displaced a sufficient distance relative to the flow communicators 218, 220, in the downhole direction, such that the flow communicators 218, 220 become disposed in the open condition. In some embodiments, for example, the displacing of the flow controller 222 is effected in response to application of fluid pressure to the flow controller 222.

Figure 8:
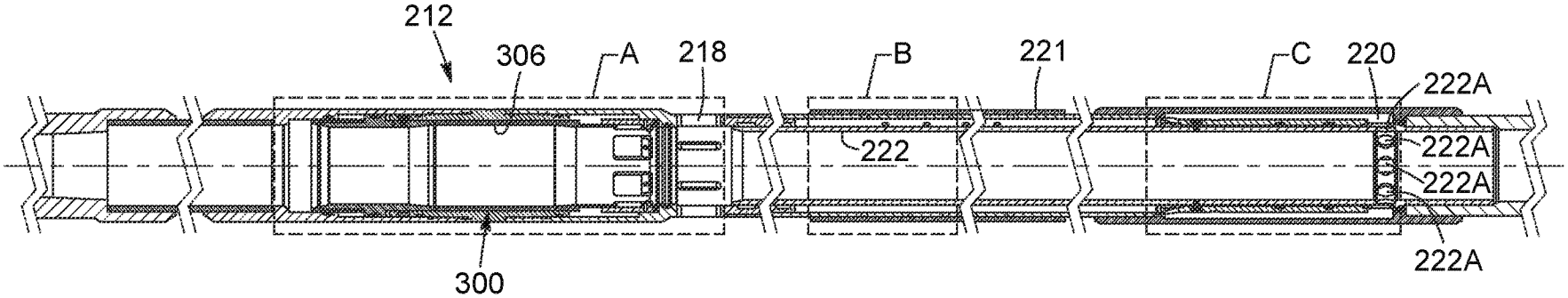
FIG. 8 is a sectional view of a flow control apparatus of the system illustrated in FIG. 1, disposed in the production-readying configuration.
Figure 9:
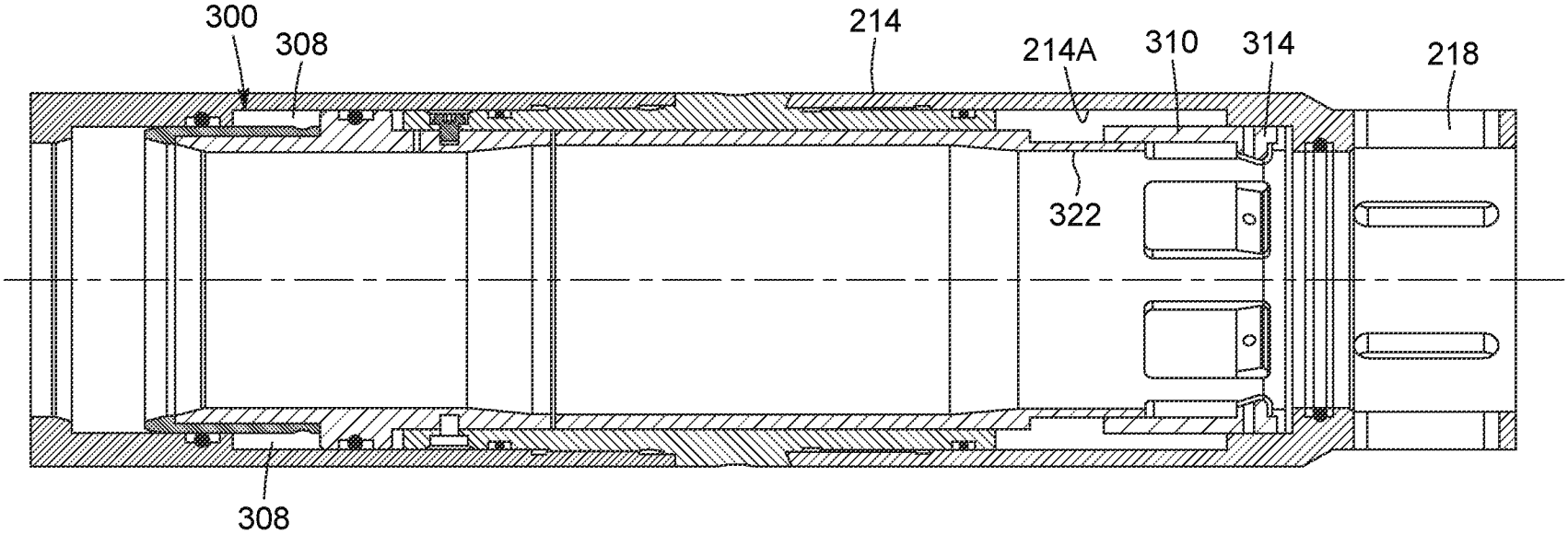
FIG. 9 is an enlarged view of Detail "A" in FIG. 8.
Figure 10:
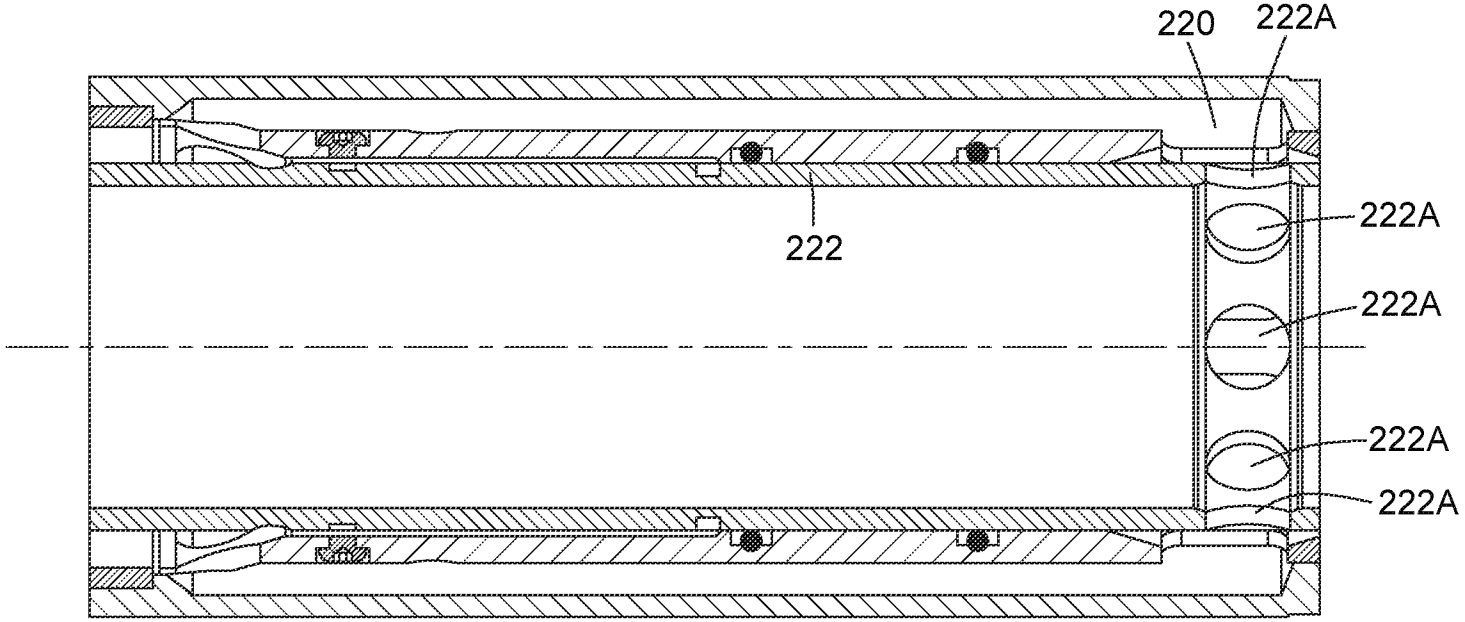
FIG. 10 is an enlarged view of Detail "C" in FIG. 8.
Figure 11:
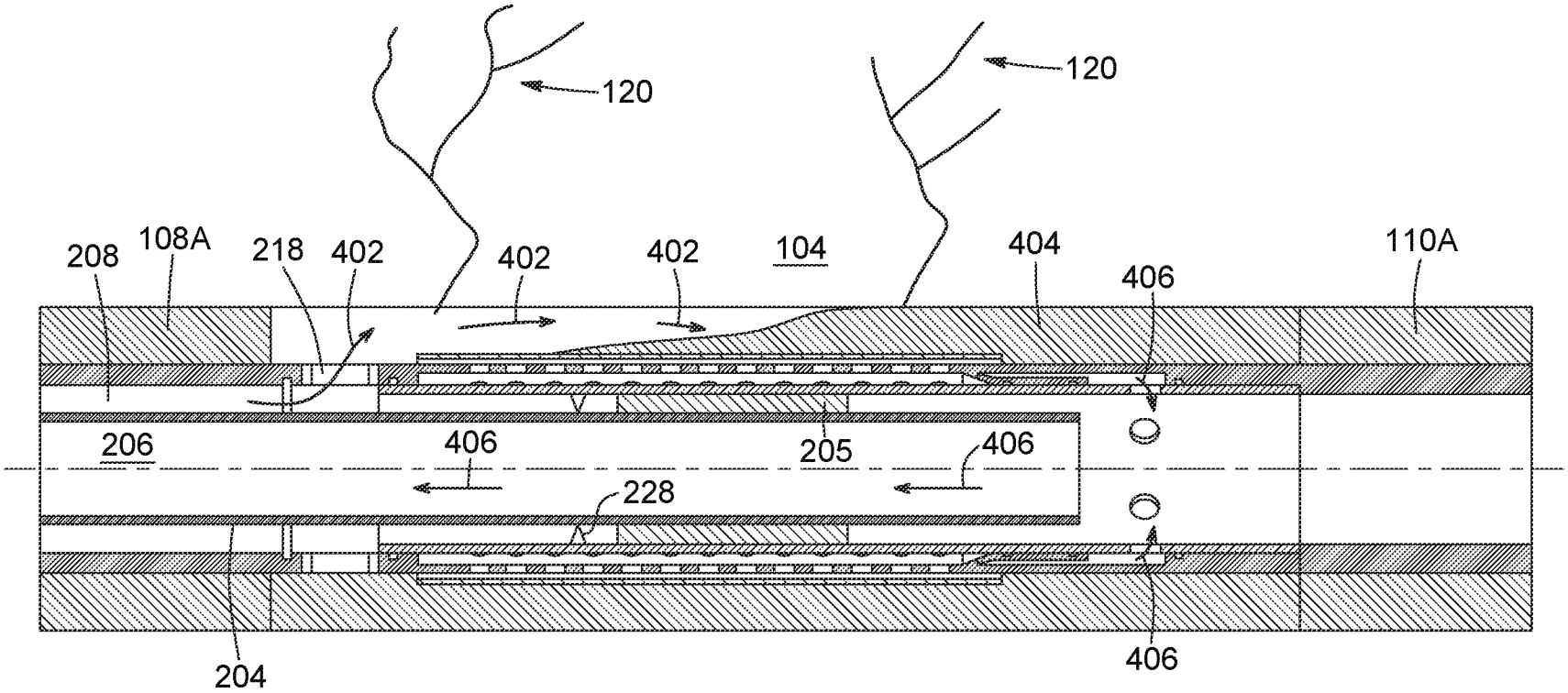
FIG. 11 is a schematic illustration of the system illustrated in FIG. 1, disposed in a downhole material supplying configuration, and illustrating gravel packing a wellbore interval.

Referring to FIGS. 8 to 10, while each one of the flow communicators 218, 220, independently, is disposed in an open condition, the flow control apparatus 212 is disposed in a production-readying configuration.

Referring to FIGS. 7 to 10, the completion 202, the fluid conducting tool string 204, the downhole-conducting fluid passage sealed interface 205A, the uphole intermediate wellbore space sealed interface 108A, and the downhole intermediate wellbore space sealed interface 110A are co-operatively configurable for disposition in a downhole material supplying configuration within the wellbore 100. In the downhole material-supplying configuration: (i) the flow control apparatus 212, of a one of the flow communication stations, is disposed in the production-readying configuration, (ii) flow communication is established, via the first flow communicator 218, between the annular fluid passage 208 and the intermediate wellbore space interval portion 106A, (iii) flow communication is established, via the second flow communicator 220, between the intermediate wellbore space interval portion 106A and the tool string-defined fluid passage 206, (iii) the portion of the completion 202, disposed uphole relative to the first flow communicator 218 of the flow control apparatus 212, defines an uphole-disposed completion-defined sealed interface 230 for preventing material disposed within the annular fluid passage 208, uphole relative to the first flow communicator 218, from being conducted externally of the wellbore string 200, (iv) the uphole-disposed completion-defined sealed interface 230 and the downhole-conducting fluid passage sealed interface 205A are co-operating for preventing material, being conducted downhole via the annular fluid passage 208, from bypassing the first flow communicator 218, (v) the uphole intermediate wellbore space sealed interface 108A is disposed for preventing material, being conducted via the first flow communicator 218, from the annular fluid passage 208 and into the intermediate wellbore space interval portion 106A, from being conducted uphole, relative to the uphole intermediate wellbore space sealed interface 108A, via the intermediate wellbore space 106, (vi) the downhole intermediate wellbore space sealed interface 110A is disposed for preventing material, being conducted via the first flow communicator 218, from the annular fluid passage 208 and into the intermediate wellbore space interval portion 106A, from being conducted downhole, relative to the downhole intermediate wellbore space sealed interface 110A, via the intermediate wellbore space 106, (vii) the portion of the completion, disposed downhole relative to the second flow communicator 220 of the flow control apparatus 212, defines a downhole-disposed completion-defined sealed interface 232 for preventing material disposed within the wellbore string space 102A, downhole relative to the second flow communicator 220, from being conducted externally of the wellbore string 102, (viii) the downhole-conducting fluid passage sealed interface 205A and the downhole-disposed completion-defined sealed interface 232 are co-operating such that material being conducted, via the second flow communicator 220, from the intermediate wellbore space 106 and into the apparatus passage 216, is prevented from bypassing the tool string-defined fluid passage 206.

In some embodiments, for example, flow communication, via the second flow communicator 220, between the intermediate wellbore space interval portion 106A and the tool string-defined fluid passage 206, is established in response to alignment between the second flow communicator 220 and throughbores 222A defined within the flow controller 222.

In some embodiments, for example, the uphole-disposed completion-defined sealed interface 230 (see FIG. 1) is established while the flow communicators 218, 220 of the other ones of the flow control apparatuses 212, disposed uphole relative to the flow control apparatus 212 (the flow control apparatus 212 that is already disposed in the production-readying configuration), are disposed in the closed condition. Because the flow communicators 218, 220 of the other ones of the flow control apparatuses 212 are disposed in the closed condition, there is an absence of flow communication, via one or more of the flow communicators 218, 220 of the other ones of the flow control apparatuses 212, between the wellbore string space 200A and the intermediate wellbore space interval portion 106A.

In some embodiments, for example, the downhole-disposed completion-defined sealed interface 232 (see FIG. 1) is established while the flow communicators 218, 220 of the other ones of the flow control apparatuses 212, disposed downhole relative to the flow control apparatus 212 (the flow control apparatus 212 that is already disposed in the production-readying configuration), are disposed in the closed condition. Because the flow communicators 218, 220 of the other ones of the flow control apparatuses 212 are disposed in the closed condition, there is an absence of flow communication, via one or more of the flow communicators 218, 220 of the other ones of the flow control apparatuses 212, between the wellbore string space 200A and the intermediate wellbore space interval portion 106A.

Referring to FIGS. 7 to 11, while the completion 202, the fluid conducting tool string 204, the downhole-conducting fluid passage sealed interface 205A, the uphole intermediate wellbore space sealed interface 108A, and the downhole intermediate wellbore space sealed interface 110A are co-operatively disposed in the downhole material supplying configuration within the wellbore 100, and the uphole-conducting fluid flow controller 224 is disposed in a closed condition (such that there is an absence of flow communication between the intermediate wellbore space interval portion 106A and the surface 102, via the second flow communicator 220 and the tool string-defined fluid passage 206), a stimulation material 400 is injectable through the annular fluid passage 208 and into the intermediate wellbore space interval portion 106A, via the first flow communicator 218, for effecting hydraulic fracturing of a corresponding zone of the subterranean formation 104 during a stimulation phase. The hydraulic fracturing produces fractures 120. In this respect, because the uphole-conducting fluid flow controller 224 is closing the tool string-defined fluid passage 206, there is an absence of flow of the stimulation material, which has been injected into the intermediate wellbore space interval portion 106A, through the second flow communicator 220. If the uphole-conducting fluid flow controller 224 was disposed in an open condition, flow communication would be established between the intermediate wellbore space interval portion 106A and the surface 102, via the second flow communicator 220 and the uphole-fluid conducting passage 206. In such circumstances, because the injected stimulation material 400 contains solid particulate material and is being injected at a relatively higher flowrate, the filter medium 221 (e.g. screen) would be susceptible to erosion by the stimulation material being flowed therethrough. In this respect, because the uphole-conducting fluid flow controller 224 is disposed in a closed condition while the flow control apparatus 212 and the fluid conducting tool string 204 are co-operatively disposed in the production-readying configuration, erosion of the filter medium 221, by stimulation material being injected through the flow communicator 221, is mitigated.

Referring to FIGS. 11 to 15, while the completion 202, the fluid conducting tool string 204, the downhole-conducting fluid passage sealed interface 205A, the uphole intermediate wellbore space sealed interface 108A, and the downhole intermediate wellbore space sealed interface 110A are co-operatively disposed in the downhole material supplying configuration within the wellbore 100, and the uphole-conducting fluid flow controller 224 is disposed in a closed condition (such that the system 10 is configured for effecting hydraulic fracturing of a zone of the subterranean formation 104, as discussed above), the system 10 is re-configurable for effecting gravel packing of the intermediate wellbore space interval portion 106A, corresponding to the zone of the subterranean formation 104 that has just been hydraulically fractured, by opening of the tool string-defined fluid passage 206 with the uphole-conducting fluid flow controller 224. In response to the opening of the tool string-defined fluid passage 206, flow communication is thereby established between the intermediate wellbore space interval portion 106A and the surface 102. Because flow communication is established between the intermediate wellbore space interval portion 106A and the surface 102, via the second flow communicator 106 and the tool string-defined fluid passage 206, formation of a gravel pack 404 within the intermediate wellbore space 106, immediately adjacent to the second flow communicator 220, in response to injection of a gravel slurry material 402 into the intermediate wellbore space interval portion 106A from the annular fluid passage 208, is facilitated during a gravel packing phase. This is because the solids-depleted fluid 406, obtained in response to separation of solid particulate materials from the injected gravel slurry material 402 (a necessary incident of the gravel packing), is conductible from the intermediate wellbore space interval portion 106A to the surface 102, via the second flow communicator 220 and the tool string-defined fluid passage 206. In some embodiments, for example, the flowrate of the injected gravel slurry material 402 is lower relative to the flowrate of the injected stimulation material, and because the flowrate of the injected gravel slurry material 402 is lower relative to the flowrate of the injected stimulation material, damage to the filter medium 221, by the injection of the gravel slurry material is not as concerning. In some embodiments, for example, the ratio of the flowrate of the injected stimulation material to the flowrate of the injected gravel slurry material is at least 1.1, such as, for example, at least 1.25, such as, for example, at least 1.5.

In some embodiments, for example, during the transitioning from the stimulation phase to the gravel packing phase, the supplying of the stimulation material is suspended. In some of these embodiments, for example, during the transitioning from the stimulation phase to the gravel packing phase, the opening of the uphole-conducting fluid flow controller 224 is effected.

In some embodiments, for example, the stimulation material 400 is the same material as the slurry material 402, such that the stimulation material 400 is the slurry material 402. In some embodiments, during the transitioning from the stimulation phase to the gravel packing phase, the slurry material 402 continues to be supplied to the wellbore interval 106, such that the supplying of slurry material 402 to the wellbore interval 106 remains uninterrupted. In some of these embodiments, for example, during the transitioning from the stimulation phase to the gravel packing phase, the opening of the uphole-conducting fluid flow controller 224 is effected.

Figure 1A:
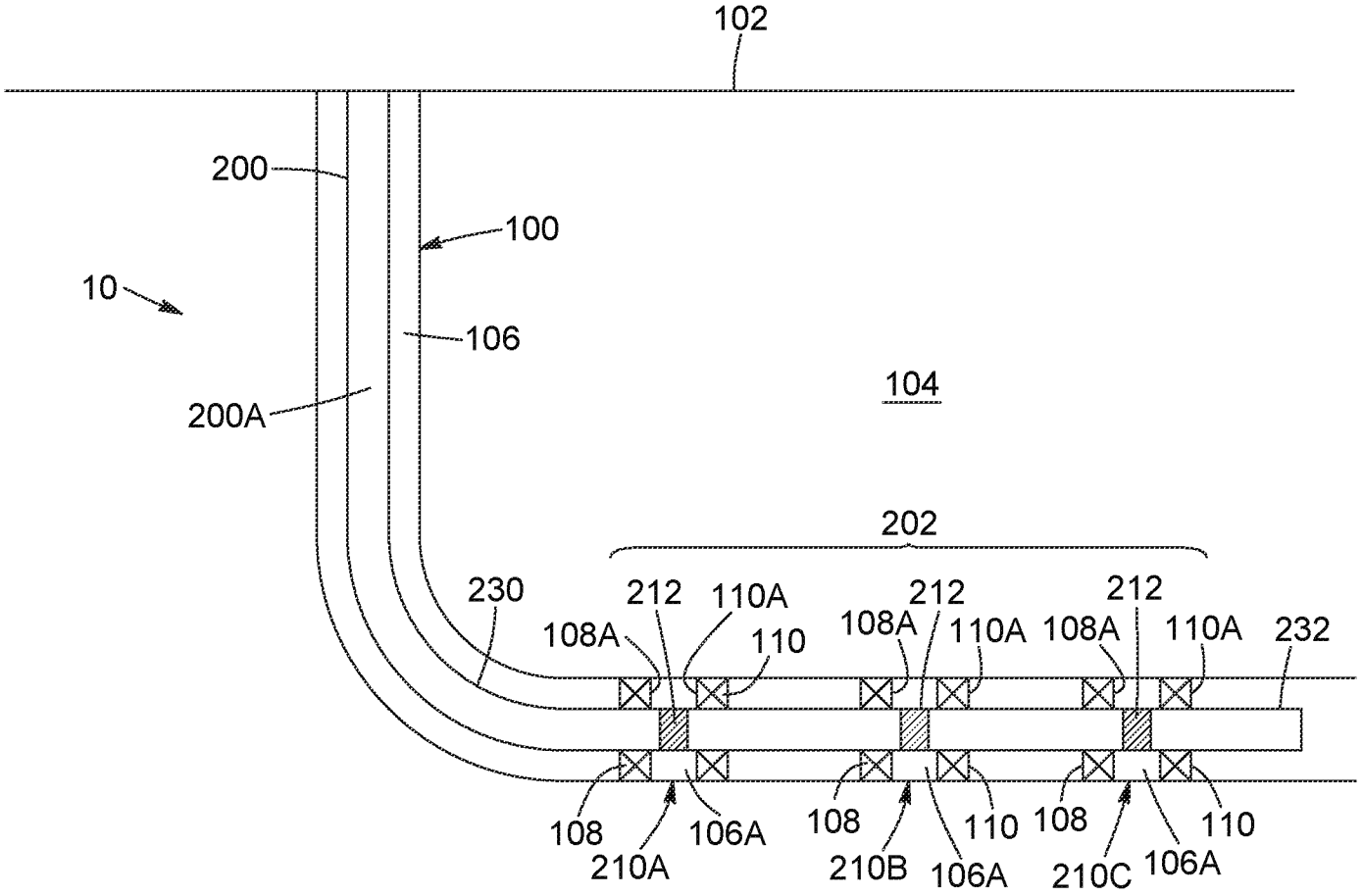
FIG. 1A is a schematic illustration of an embodiment of a system of the present disclosure.

Referring to FIG. 1A, in some embodiments, for example, the fluid flow resistance between the wellbore interval 106A and the surface 102, via the flow control apparatus 212 (including that through the flow communicator 220) and the fluid conducting tool string 204, is sufficiently significant such that the flow through the filter medium 221 is sufficiently slow such that erosion of the filter medium 221 (e.g. screen) during the stimulation phase is not a significant concern. In some of these embodiments, for example, it is unnecessary for the system 10 to include the uphole-conducting fluid flow controller 224 so as to prevent return flow, via the flow communicator 220, to the surface 102.

It is understood that the order of operations can be reversed. In this respect, in some embodiments, for example, gravel packing of the wellbore interval can be effected, and, after the gravel packing, stimulation material can be injected to effect hydraulic fracturing of the subterranean formation 104 can be effected. In those embodiments where the uphole-conducting fluid flow controller 224 is provided to mitigate erosion of the filter medium 221, initially, the uphole-conducting fluid flow controller 224 can be disposed in the open condition for facilitating the gravel packing operation, and can then be closed during the stimulation phase.

Prior to producing the formation 104, the tool string 205 is removed from the wellbore 100. After the tool string 205 is removed the wellbore 100, the produced hydrocarbon-comprising fluid material is produced at the surface 102.

In some embodiments, for example, the actuation of the shifting tool 228 into the engagement with the flow controller 222 is a mechanical actuation, and the actuation of the sealed interface effector 208, with effect that the sealed interface 205A is established, is also a mechanical actuation.

In some embodiments, for example, the shifting tool 228 and the sealed interface effector 208 are deployed downhole as part of a bottomhole assembly 500. In some embodiments, for example, the bottomhole assembly 500 defines a downhole end of the tool string 205.

In some embodiments, for example, the bottomhole assembly 500 is similar to the bottomhole assembly described in U.S. patent application Ser. No. 14/830,507, which is incorporated by reference in its entirety herein, and the actuation of the shifting tool 228 (e.g. mechanical slips) and the sealed interface effector (e.g. packer) corresponds to that, of the corresponding shifting tool and sealed interface effector, described in U.S. patent application Ser. No. 14/830,507. In some of these embodiments, for example, the bottomhole assembly 500 includes an equalization valve for facilitating unsetting of the sealed interface effector 208 (e.g. packer), to enable movement of the tool string 205 to another interval for: (i) hydraulic fracturing of the corresponding zone of the another interval, and (ii) gravel packing of such interval.

To accommodate the requisite fluid flows during each one of hydraulic fracturing and gravel packing (as described above), while still facilitating circulation (e.g. for removal of solid particulate, that has deposited within the intermediate passage defined between fluid conducting tool string 204 and the wellbore string 200, such as solid particulate that has deposited during the stimulation or gravel packing operations) and pressure equalization (e.g. for unsetting the packer), in some embodiments, for example, the equalization valve assembly is suitably modified. In some embodiments, for example, the equalization valve assembly of the bottomhole assembly described in U.S. patent application Ser. No. 14/830,507 is replaced with the crossover tool 502 illustrated in FIGS. 26 to 29.

The crossover tool 502 includes an upper mandrel 504 and a lower mandrel 506 which co-operatively define a housing 503. The upper mandrel 504 defines an upper mandrel passage 508, and the lower mandrel defines a lower mandrel passage 510. The upper and lower mandrel passages 508, 510 co-operate to define a cross-over tool passage 512, the cross-over tool passage 512 defining at least a portion of the tool string-defined fluid passage 206. A pressure equalization flow communicator 514 (for example, defined by one or more ports) is defined through the housing for effecting flow communication between the annular fluid passage 208 and the cross-over tool passage 512. The upper mandrel 504 and the lower mandrel 506 co-operate to define an equalization valve 515 for sealing flow communication, via the flow communicator 514, between the annular fluid passage 208 and the cross-over tool passage 512. In this respect, the upper mandrel 504 defines a plug 516 of the equalization valve 515, and the lower mandrel 506 defines a seat 518 of the equalization valve 515. The seat 518 is configured to receive the plug 516 such that, while the plug 516 is seated on the seat 518, the equalization valve 514 is closed. The closure of the equalization valve 515 seals flow communication, via the flow communicator 514, between the annular fluid passage 208 and the cross-over tool passage 512.

Disposed within the upper mandrel passage 508, uphole relative to the equalization valve 515, is a tool passage flow-controlling check valve 520. The tool passage flow-controlling check valve 520 is configured for: (i) opening in response to establishing of a sufficient fluid pressure differential, within the mandrel passage 508, across the check valve 520, wherein the sufficient fluid pressure differential is established by a fluid pressure, acting over the downhole surface of a valve member of the check valve 520, sufficiently exceeding a fluid pressure acting over the uphole surface of the valve member of the check valve 520, and (ii) preventing flow through the mandrel passage 508 in a downhole direction across the check valve 520.

The cross-over tool further includes a flow circulation-controlling check valve 522 configured for: (i) opening in response to establishing of a sufficient fluid pressure differential, across the check valve 522, wherein the sufficient fluid pressure differential is established by a fluid pressure within the mandrel passage 508, acting over a tool passage-facing surface of a valve member of the check valve 522, sufficiently exceeding a fluid pressure within the annular fluid passage 208 acting over annular fluid passage-facing surface of the valve member of the check valve 522, and (ii)

preventing flow, across the check valve 522 (via communication passage 524), from the annular fluid passage 208 to the mandrel passage 508.

Figure 26:
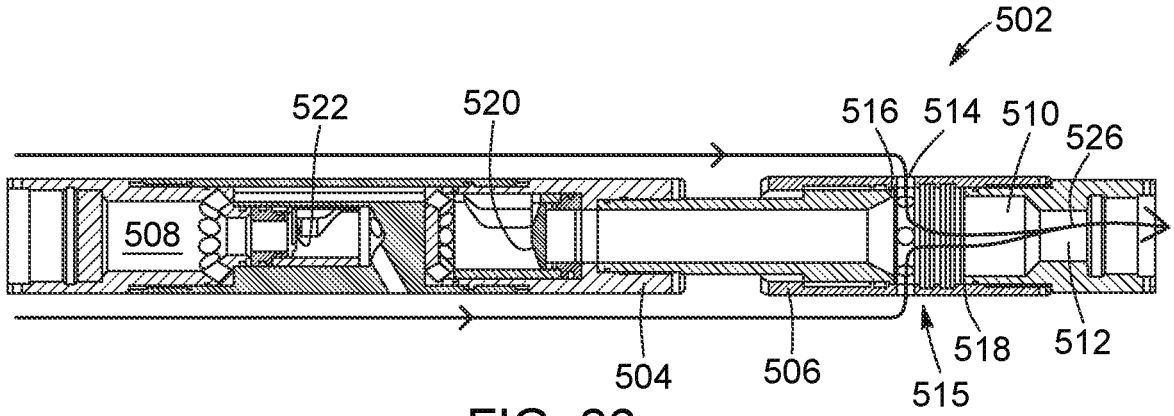
FIG. 26 is a cross-sectional view of a cross-over tool of an embodiment of a system of the present disclosure, showing the cross-over tool in a pressure equalization mode.

FIG. 26 illustrates the cross-over tool 502 disposed in a pressure equalization mode for, amongst other things, facilitating the unsetting of the sealed interface effector 208 (e.g. packer). In this respect, flow communication is effected, via the pressure equalization flow communicator 514, between the annular fluid passage 208 and the cross-over tool passage 512, for dissipating fluid pressure within the annular fluid passage 208, by evacuation of fluid from the annular fluid passage 208 in accordance with the flowpath 526.

Figure 27:
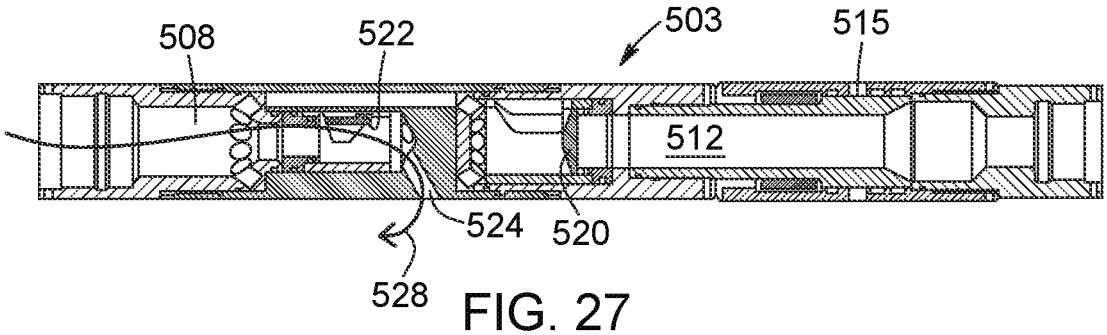
FIG. 27 is a cross-sectional view of the cross-over tool illustrated in FIG. 26, showing the cross-over tool in a circulation mode.

FIG. 27 illustrates the cross-over tool 502 disposed in a circulation mode for, amongst other things, removing solid particulate from the annular fluid passage 208 (such as, for example, after a gravel packing operation). In this respect, fluid is flowed from the surface 102, downhole through the upper mandrel passage 508, urges opening of the check valve 522, with effect that the fluid is conducted to the annular fluid passage 208 via the communication passage 524, and then recirculated to the surface 102 with entrained solid particulate that has been carried by the conducted fluid, in accordance with the flowpath 528. Notably, flow of such fluid, through the upper mandrel passage 508, downhole of the communication passage 524 is prevented by the check valve 520, and the fluid within the annular fluid passage is prevented from re-entering the tool string-defined fluid passage 206 by the closed equalization valve 515.

Figure 28:
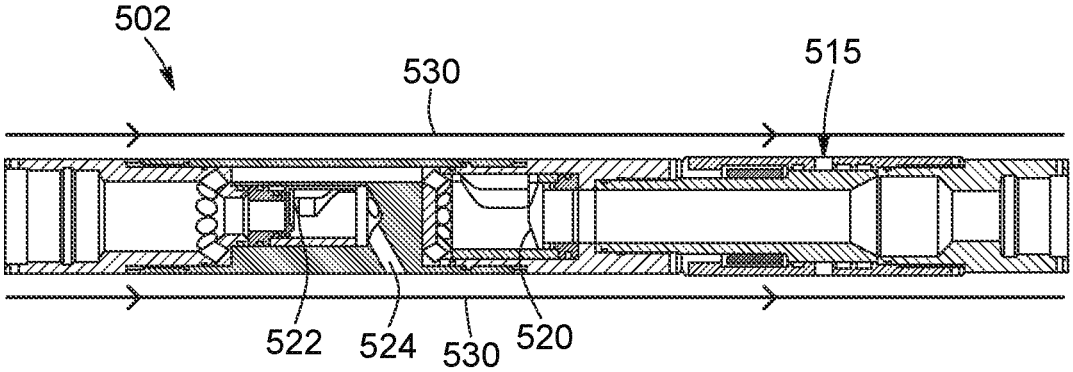
FIG. 28 is a cross-sectional view of the cross-over tool illustrated in FIG. 26, showing the cross-over tool in a hydraulic fracturing mode.

FIG. 28 illustrates the cross-over tool 502 disposed in a hydraulic fracturing mode for stimulating the subterranean formation 100 via hydraulic fracturing. As illustrated, the stimulation material is conducted downhole through the annular fluid passage 208, externally of the cross-over tool 502, in accordance with the flowpath 530. Notably, the check valve 522 and the closed equalization valve 515 prevent the stimulation material from being flowed into the tool string-defined fluid passage 206. Return flow is prevented, in the uphole direction through the tool string-defined fluid passage 206, by the closed flow controller 224.

Figure 29:
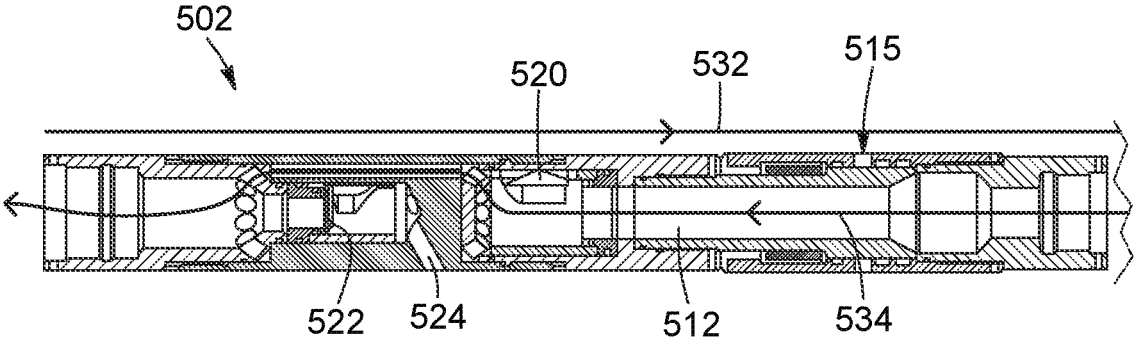
FIG. 29 is a cross-sectional view of the cross-over tool illustrated in FIG. 26, showing the cross-over tool in a gravel packing mode.

FIG. 29 illustrates the cross-over tool 502 disposed in a gravel packing mode. In the gravel packing mode, gravel slurry material is conducted downhole through the annular fluid passage 208, externally of the cross-over tool 502, in accordance with the flowpath 532. Notably, the check valve 522 and the closed equalization valve 515 prevent the gravel slurry material, being conducted downhole, from being flowed into the tool string-defined fluid passage 206. The return fluid is conducted in an uphole direction through the tool string-defined fluid passage 206 (including the cross-over tool passage 512) to the surface 102 in accordance with flowpath 534. The return fluid flows past the closed equalization valve 515, being prevented from being discharged into the annular fluid passage 208 by the closed equalization valve 515, urges opening of the check valve 520, and flows through the check valve 520. While the return fluid is flowing past the check valve 522, the check valve 522 remains closed. This is because the pressure, of the gravel slurry material being conducted downhole through the annular fluid passage 208, being communicated to the annular fluid passage-facing surface of the valve member of the check valve 522 via the communication passage 524, exceeds the pressure of the return fluid on the opposite side of the valve member of the check valve 522.

Referring to FIGS. 15 to 18, after completion of the hydraulic fracturing and gravel packing, the flow controller 222 is then displaced (such as, for example, in the uphole direction), relative to the housing 214, for effecting closing of the flow communicators 218, 220. In this respect, while both of the flow communicators 218, 220 are disposed in the closed condition, the flow control apparatus 212 is disposed in an intermediate closed configuration. In some embodiments, for example, the displacing of the flow controller 222, resulting in the transitioning of the flow control apparatus 212 from the production-readying mode to the intermediate closed configuration, is effected by the shifting tool 228, and in response to a pulling up force applied to the tool string 204. While the flow control apparatus 212 is disposed in the intermediate closed configuration, hydraulic fracturing and/or gravel packing, of other intervals of the wellbore 100 and corresponding zones of the subterranean formation 100, can be effectuated.

Figure 20:
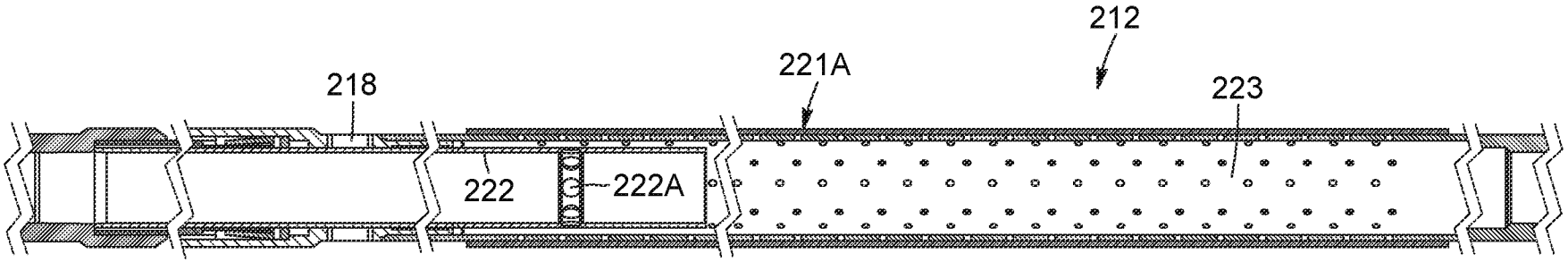
FIG. 20 is a sectional view of a flow control apparatus of the system illustrated in FIG. 1, disposed in the production configuration.

After these other operations at the other flow control stations are completed, the tool string 204, or another tool string, is returned to manipulate the flow control apparatus 212, such that the flow control apparatus 212 is transitioned from the intermediate closed configuration to a production configuration. In the production configuration, the flow control apparatus 212 becomes disposed for receiving production of hydrocarbon material from the subterranean formation 104. In this respect, and referring to FIGS. 19 and 20, to transition the flow control apparatus 212 from the intermediate closed configuration to the production configuration, the flow controller 222 is displaced (such as, for example, in the uphole direction), relative to the housing 214, with effect that the second flow communicator 220 becomes opened, while the first flow communicator 218 remains disposed in the closed condition. As a result, because the hydrocarbon material 408, being produced from the subterranean formation 104, is being diverted from the closed first flow communicator 218 to the second flow communicator 220, solids can be filtered from the hydrocarbon material 408, which is being produced, by the formed gravel pack 404, before being conducted uphole to the surface 102

In some embodiments, for example, the displacing of the flow controller 222, with effect that the flow control apparatus 212 is transitioned from the intermediate closed configuration to the production configuration, is effectible by the shifting tool 228. In some of these embodiments, this transitioning is effectible by the shifting tool 228 in response to a pulling up force being applied to the tool string 204.

In some embodiments, for example, the transitioning from the production-readying mode to the intermediate closed configuration, and then from the intermediate closed configuration to the production mode, requires displacement of the flow controller 222, relative to the housing 214, in two separate sequential uphole movements of the flow controller 222, is effected in response to pulling up of the tool string 204. In some of these embodiments, for example, an indication is provided to an operator at the surface 102, when the flow controller 222 has become disposed relative to the flow communicators 218, 220 such that the flow control apparatus 212 becomes disposed in the intermediate closed configuration (both of the flow communicators 218, 220 are disposed in closed conditions). Such an indication is provided so as to provide the operator sufficient time to respond by suspending the pulling up on the tool string 204. Otherwise, the flow controller 222 could be inadvertently pulled past the position which corresponds to the flow control apparatus 212 being disposed in the intermediate closed configuration. In this respect, such uphole indication, that the pulling up on the tool string 204 should be suspended, is effectuated by integrating a transition impeder 300 into the flow control apparatus 212.

Without the transition impeder 300, it may be necessary to co-operatively configure the flow controller 222 and the wellbore string 200 such that an intermediate interference to the displacement of the flow controller 222 is dynamically introduced such that positioning of the flow controller 222 is establishable in more than two (2) positions by hard stops provided by the wellbore string 200. This would necessitate the flow controller 222 undergoing displacements in both uphole and downhole directions during transitioning between each of these positions. In this respect, by providing the transition impeder 300, amongst other things, the transitioning between the first and third configurations is effectible in the absence of a displacement of the flow controller 222 in the downhole direction.

Referring to FIGS. 4, 9, 13, 17, and 21 to 25, the transition impeder 300 includes a transition-impeding fluid passage 302 and a viscous fluid 304 disposed for flow within the transition impeding fluid passage 302. The flow of the viscous fluid 304, through the transition impeding fluid passage 302, is effected in response to the transitioning of the flow control apparatus 212 from the intermediate closed configuration to the production configuration. Resistance to the flow, of the viscous fluid 304 through the transition impeding fluid passage 302, impedes the transition in the configuration of the flow control apparatus 212 from the intermediate closed configuration to the production configuration.

In some embodiments, for example, an exemplary viscous fluid includes grease, such as, for example, lithium-based grease, such as, for example, NLGI-grade grease.

This resistance to flow is able to be detected by an operator at the surface 102 with a weight indicator. In response to the detected resistance, the operator would then suspend the pulling up on the tool string 204.

Figure 21:
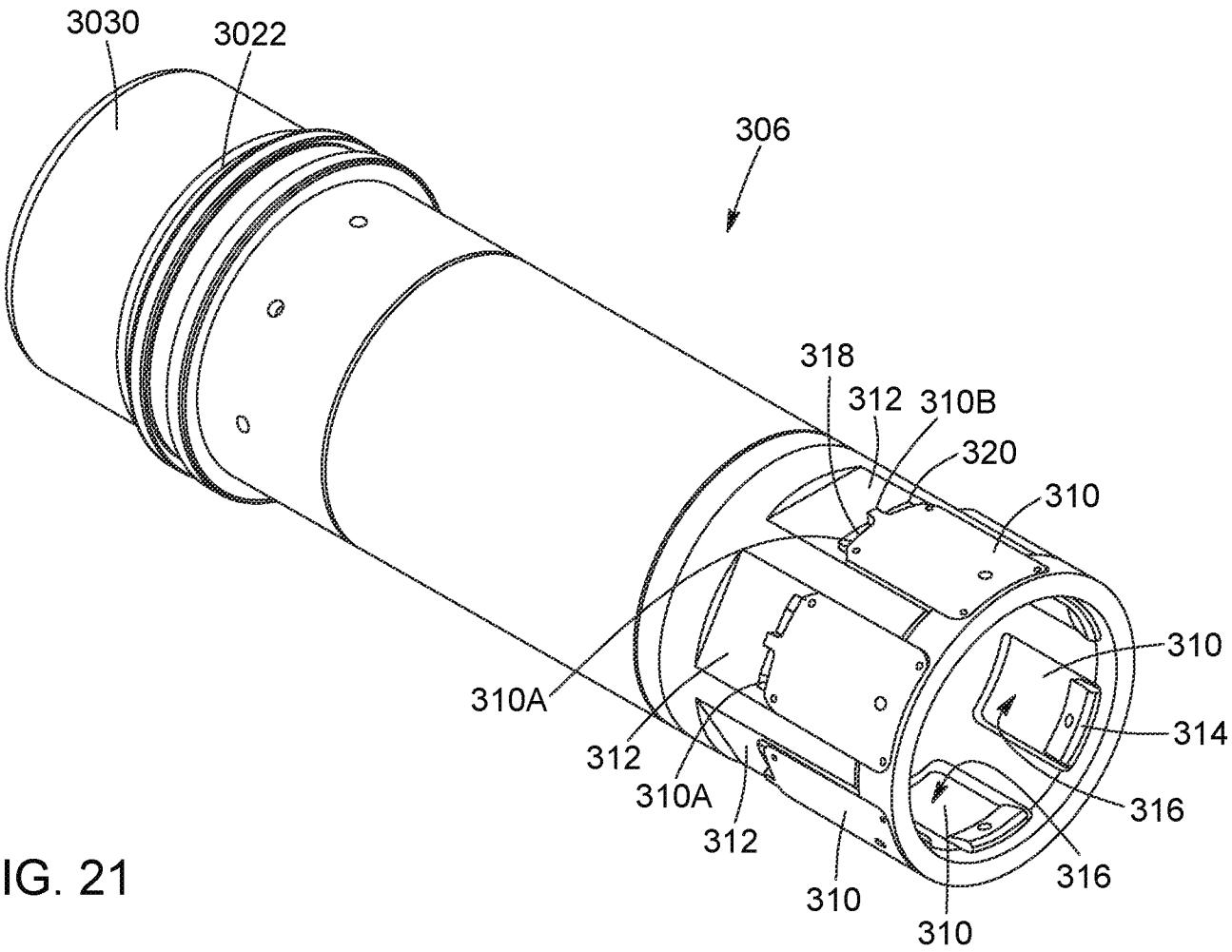
FIG. 21 is a perspective view of the impeder piston of a flow control apparatus of the system illustrated in FIG. 1, taken from a first end of the impeder piston.
Figure 22:
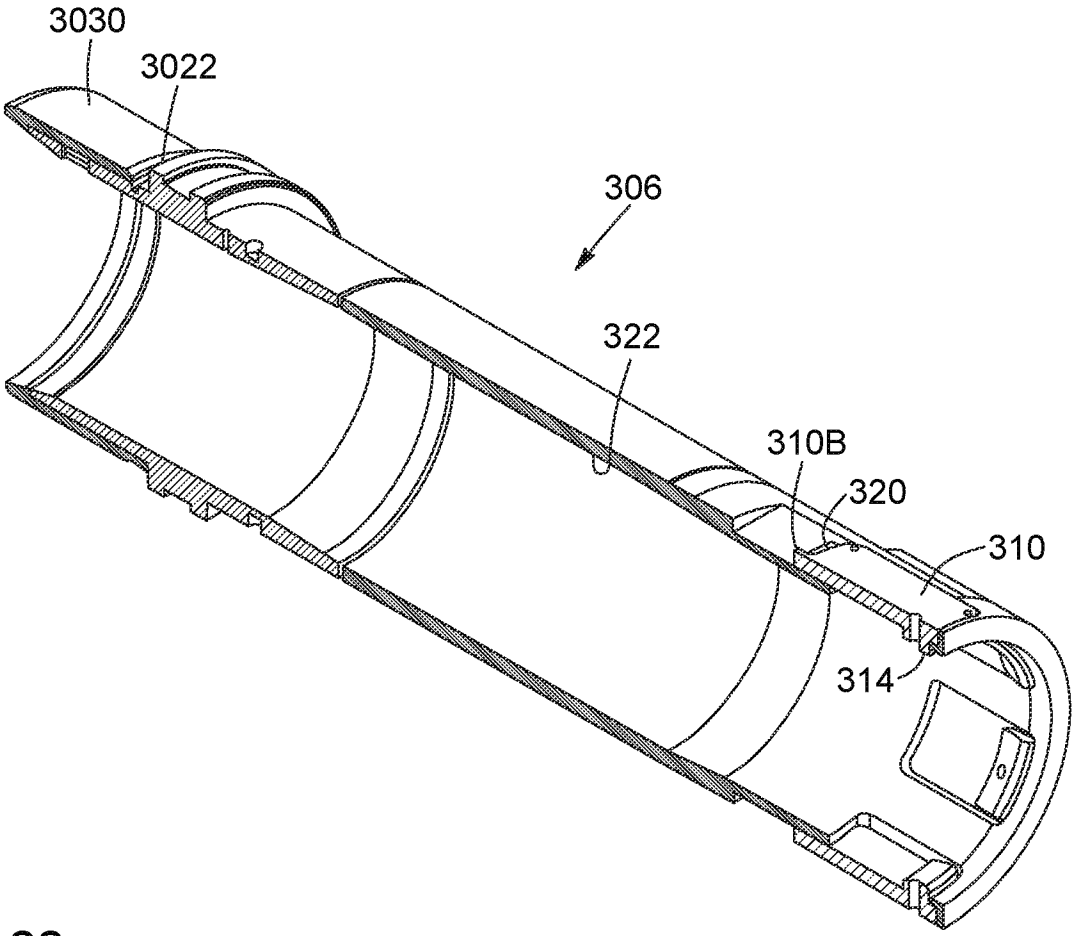
FIG. 22 is a perspective view of a section of the impeder piston illustrated in FIG. 21, taken from the first end of the impeder piston.
Figure 23:
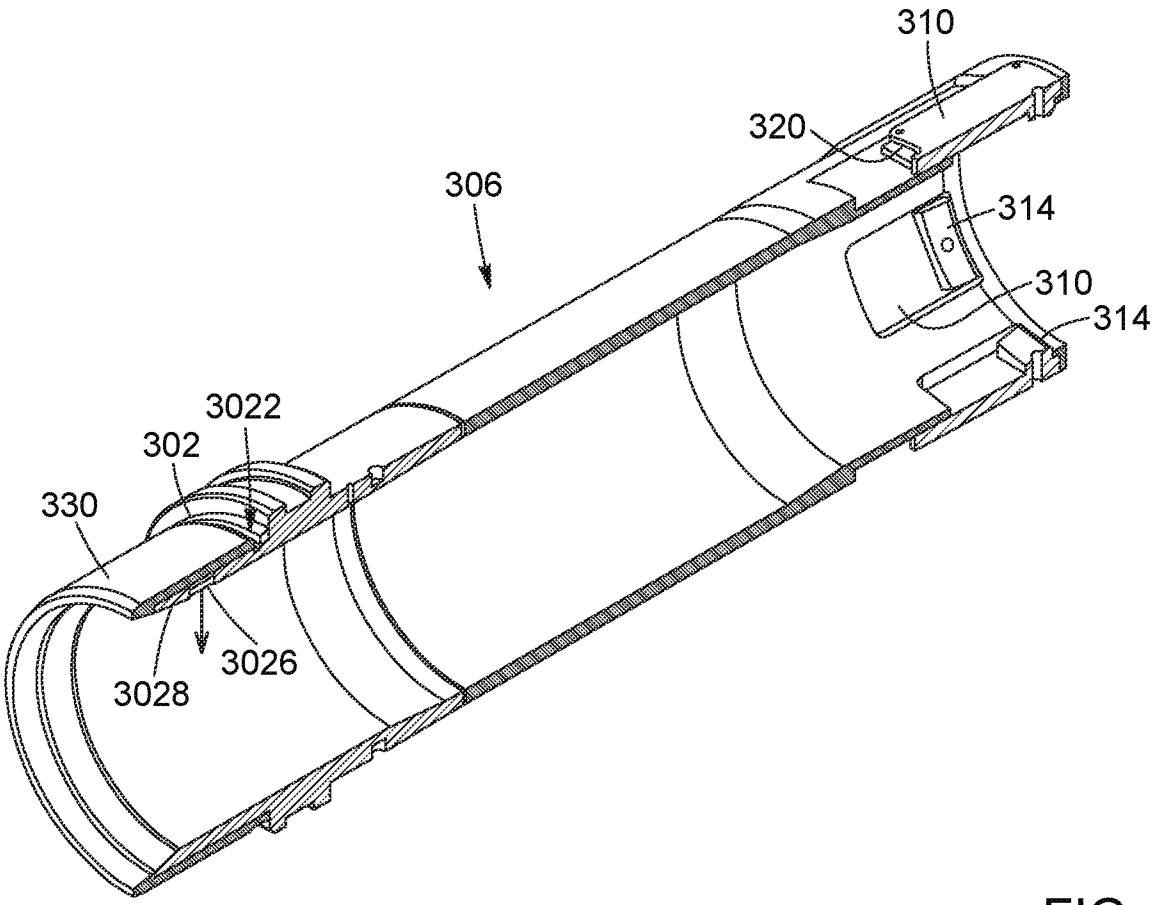
FIG. 23 is perspective of a section of the impeder piston illustrated in FIG. 21 taken from a second end of the impeder piston.
Figure 24:
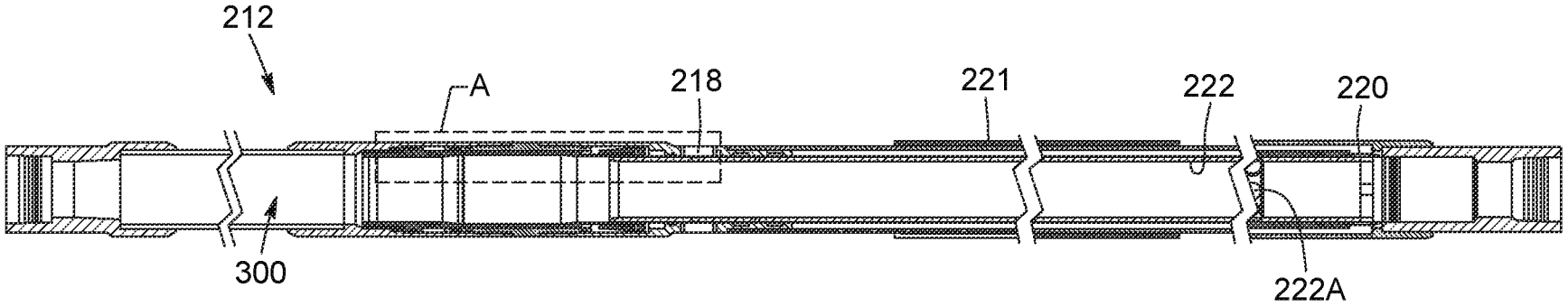
FIG. 24 is a sectional view of a flow control apparatus of the system illustrated in FIG. 1, with the flow controller, the impeder piston, and the housing disposed in a non-impeding configuration, and thereby permitting the flow control apparatus to transition to the production configuration.
Figure 25:
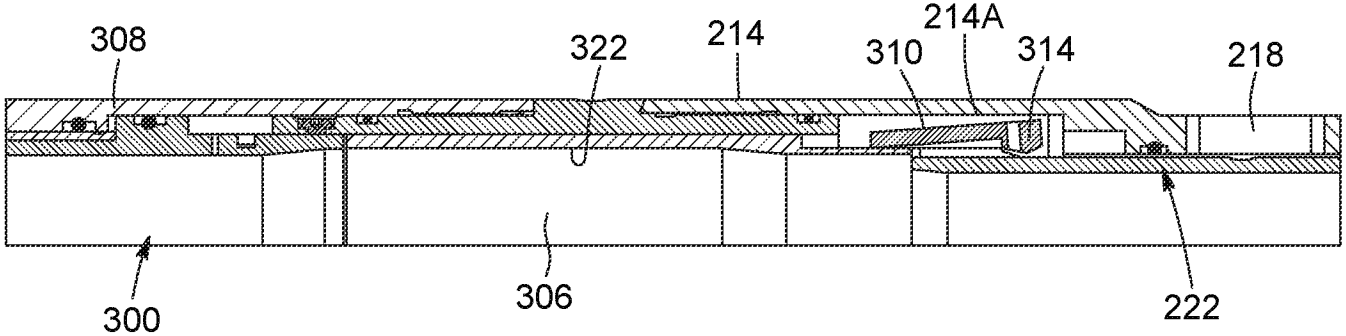
FIG. 25 is an enlarged view of Detail "A" in FIG. 24.

Referring to FIGS. 21 to 23, in some embodiments, for example, the flow control apparatus 212 includes an impeder piston 306. In some embodiments, for example, the impeder piston 306 is in the form of a sleeve. In some embodiments, for example, the impeder piston 306 is displaceable relative to the housing 214 along an axis that is parallel to the central longitudinal axis of the apparatus passage 216, and the displaceability of the flow controller 222 relative to the housing 214 is also along an axis that is parallel to the central longitudinal axis of the apparatus passage 216. The flow controller 222 and the impeder piston 306 are configurable in a translatable configuration. In the translatable configuration, the impeder piston 306 translates with the flow controller 222 as a co-operating unit, along an axis that is parallel to the central longitudinal axis of the apparatus passage 216, in response to urging of displacement of the flow controller 222, relative to the housing 214, along an axis that is parallel to the central longitudinal axis of the apparatus passage 216. During the transitioning of the flow control apparatus 212 from the intermediate closed configuration to the production configuration, the impeder piston 306 and the flow controller 222 are disposed in the translatable configuration. In some embodiments, for example, the translatable configuration is obtained in response to engagement of the flow controller 222 with the impeder piston 306.

Referring to FIGS. 4, 9, 13, 17, and 25, the impeder piston 306 and the housing 214 are co-operatively configured such that a contractible compartment 308 is defined between the impeder piston 306 and the housing 214. The contractible compartment 308 is disposed in flow communication with the transition impeding fluid passage 302. Referring to FIGS. 21 to 23, the transition impeding fluid passage 302 is defined within the impeder piston 306 and is disposed in flow communication with the compartment 308 via an inlet 3022. In some embodiments, for example, at least a portion of the transition impeding fluid passage 302 defines a tortuous path. In some embodiments, for example, the transition impeding fluid passage 302 effects flow communication between the contractible compartment 308 and the apparatus passage 216, such that viscous fluid, which is flowing through the transition impeding fluid passage 302, is dischargeable into the apparatus passage 216 via a transition impeding fluid passage outlet 3026. In some embodiments, for example, the transition impeding fluid passage 302 is defined between first and second counterparts 3028, 3030. In some embodiments, for example, the first counterpart 3028 defines the tortuous path that extends into the outlet 3026. The second counterpart 3030 functions as a cap that is press fit over the first counterpart 3028, and defines the slots 3022 for effecting communication with the compartment 308. At least a portion of the viscous fluid is disposed within the contractible compartment 308, and, in this respect, the impeder piston 306 is disposed in force communication with the viscous fluid 304.

The flow controller 222, the impeder piston 306, the housing 214, the contractible compartment 308, and the viscous fluid 304 are co-operatively configured such that, during the transitioning of the configuration of the flow control apparatus 212 from the intermediate closed configuration to the production configuration, the impeder piston 306 translates with the flow controller 222 in the translatable configuration, such that contraction of the contractible compartment 308 is effected, and such that the viscous fluid, disposed within the contractible compartment, is urged to flow through the transition-impeding fluid passage 302. The urging of the flow of the viscous fluid is with effect that the flow of the viscous fluid 304, through the transition impeding fluid passage 302, is established, and such that the displacement of the co-operating unit, including the flow controller 222, is impeded.

In some embodiments, for example, the impeder piston 306, the flow controller 222, and the housing 214 are co-operatively configured such that, while the impeder piston 306 is translating with the flow controller 222 in the translatable configuration, prior to the flow control apparatus 212 becomes disposed in the production configuration, the translatability of the impeder piston 306 with the flow controller 222 is defeated. The defeating of the translatability of the impeder piston 306 with the flow controller 222 is with effect that there is an absence of impeding of the remainder of the transitioning of the flow control apparatus 212, from the intermediate closed configuration to the production configuration, by resistance to the flow, of the viscous fluid 304 through the transition impeding fluid passage 302.

In this respect, in some embodiments, for example, the impeder piston 306 includes an engagement tab 310. The translation of the impeder piston 306 with the flow controller 222 is effected only while the flow controller 222 is engaged to the engagement tab 310, such that the translatable configuration is established only while the flow controller 222 is engaged to the engagement tab 310.

In some embodiments, for example, the impeder piston 306 includes a sleeve 322, and the engagement tab 310 is nested within a recessed surface 312, defined within an outer surface of the sleeve 322, and is free to be displaced outwardly relative to the recessed surface 312. The engagement tab 310 includes an inwardly-depending projection 314 extending through an aperture 316 defined through the sleeve 322. The inwardly-depending projection 314 is for interfering with displacement of the flow controller 222, relative to the housing 214, in the uphole direction along an axis that is parallel to the central longitudinal axis of the apparatus passage 216. In response to the interference, the co-operating unit is established.

In some embodiments, for example, a pair of retaining tabs 318, 320, extend outwardly from the recessed surface 312, for retaining the engagement tab 310 relative to the sleeve 322, with effect that axial displacement of the engagement tab 310, relative to the sleeve 322, is prevented, and with effect that lateral displacement of the engagement tabs 310, relative to the sleeve 322, is prevented. In this respect, an uphole end 310A of the engagement tab 310 is disposed in abutting engagement with the retaining tabs 318, 320, for preventing the axial displacement, and an axially extending projection 310B is disposed between the retaining tabs 318, 320 for preventing the lateral displacement.

The flow controller 222 and the impeder piston 306 are co-operatively configured such that, while the translatable configuration is established, and while displacement of the flow controller 222, relative to the housing 214, is being urged along an axis that is parallel to the central longitudinal axis of the apparatus passage 216, the engagement tab 310 is urged outwardly relative to the central longitudinal axis of the apparatus passage 216. So long as there is interference to the outwardly displacement of the engagement tab 310, the co-operating unit remains established while the outwardly displacement is being urged (see FIG. 17). Once the interference is defeated, the urging of the outwardly displacement causes the outwardly displacement, thereby resulting in the defeating of the engagement between the projection 314 and the flow controller 222 (see FIG. 25). The defeating is with effect that there is an absence of impeding of further displacement of the flow controller 222, relative to the housing 214, in the uphole direction, by resistance to the flow, of the viscous fluid 304 through the transition impeding fluid passage 302.

In this respect, the flow controller 222, the impeder piston 306, and the housing 214 are co-operatively configured for disposition in an impeding configuration. In the impeding configuration, while the translatable configuration is established, and the outwardly displacement of the engagement tab 310, relative to the central longitudinal axis of the apparatus passage 216, is being urged, and while displacement of the flow controller 222, relative to the housing 214, is being urged along an axis that is parallel to the central longitudinal axis of the apparatus passage 216, the housing 214 is interfering with the outwardly displacement of the engagement tab 310, such that the engagement of the flow controller 222 to the engagement tab 310 is maintained. In this respect, in the impeding configuration, the housing 214 is closely spaced relative to the engagement tab 310.

The flow controller 222, the impeder piston 306, and the housing 214 are further co-operatively configured for disposition in a non-impeding configuration. In the non-impeding configuration, while the translatable configuration is established, and the outwardly displacement of the engagement tab 310, relative to the central longitudinal axis of the apparatus passage 216, is being urged, and while displacement of the flow controller 222, relative to the housing 214, is being urged along an axis that is parallel to the central longitudinal axis of the apparatus passage 216, there is an absence of interference, by the housing 214, to the outwardly displacement of the engagement tab 310, such that the engagement tab 310 is displaced outwardly relative to the central longitudinal axis of the apparatus passage 216, with effect that the engagement of the flow controller 222 and the engagement tab 310 is defeated. The defeating of the engagement is with effect that the impeding, by the transition impeder, of the transitioning of the flow control apparatus 212 from the intermediate closed configuration to the production configuration, is defeated. While there is an absence of the impeding, in response to further urging of the displacement of the flow controller 222, relative to the housing 214 in the uphole direction, the flow controller 222 is displaced through the impeder piston 306, with effect that the flow control apparatus 212 becomes disposed in the closed configuration. In this respect, in the non-impeding configuration, the housing 214 defines a housing portion 214 that is sufficiently spaced from the engagement tab 310 such that the engagement tab 310 is sufficiently displaceable, in response to the urging of the displacement of the flow controller 222 relative to the housing 214, for effecting the defeating of the impeding.

In some embodiments, for example, transitioning from the impeding configuration to the non-impeding configuration is effectible in response to the displacement of the co-operating unit relative to the housing. In this respect, the flow controller 222, the impeder piston 306, and the housing 214 are further co-operatively configured for transitioning from the impeding configuration to the non-impeding configuration. The transitioning of the configuration of the flow controller 222, the impeder piston, 306 and the housing 214 from the impeding configuration to the non-impeding configuration is effected in response to the displacement of the co-operating unit relative to the housing 214. In some embodiments, for example, the housing 214 is co-operatively shaped such that, in response to the displacement of the co-operating unit relative to the housing 214, the engagement tab 310 becomes disposed in a wider passage-defining portion 214A of the housing 214 such that the interference to the outward displacement of the engagement tab 310 is defeated.

In some embodiments, for example, the retaining tabs 318, 320 are configured to fracture, in response to application of sufficient force (such as, for example, force applied by jars on the tool string 204), when the impeder piston 306 becomes inadvertently locked relative to the apparatus 212, while the impeder piston 306 is disposed in engagement with the flow controller 222 during the transitioning of the flow control apparatus 212 from the intermediate closed configuration to the production configuration. In this respect, in response to the fracturing of the retaining tabs 318, 320, the retaining tabs 318, 320 continue to remain engaged to the flow controller 222 and become moveable along the recessed surface in response to urging of the displacement of the flow controller 222, relative to the housing 214, in the uphole direction. Sufficient space is provided for permitting sufficient displacement of the fractured retaining tabs 318, 320, in response to the urging by the flow controller 222, while the flow controller 222 is being displaced relative to the housing, such that the flow control apparatus 212 becomes disposed in the production configuration.

In some embodiments, for example, the transition impeder 300 is configurable in an enabled configuration and in a disabled configuration. While the flow control apparatus 212 is transitioning from the intermediate closed configuration to the production configuration, the transition impeder 300 is disposed in the enabled configuration for impeding the transitioning. However, while the flow control apparatus 212 is transitioning from the production-readying configuration to the intermediate closed configuration, the transition impeder 300 is disposed in the disabled configuration such that there is absence of impeding of the transitioning.

In this respect, in some embodiments, for example, there is an absence of flow of the viscous fluid 304, through the configuration change-impeding fluid passage 302, while the flow control apparatus 212 is transitioning from the production-readying configuration to the intermediate closed configuration. Also in this respect, in some embodiments, for example, while the flow control apparatus 212 is transitioning from the production-readying configuration to the intermediate closed configuration, there is an absence of translation of the impeder piston 306 with the flow controller 222. Also, in this respect, the flow controller 222, the impeder piston 306, the housing 214, the contractible compartment 308, and the viscous fluid 304 are co-operatively configured such that, during the transitioning of the configuration of the flow control apparatus 212 from the production-readying configuration to the intermediate closed configuration, there is an absence of translation of the impeder piston 306 with the flow controller 222. In some embodiments, for example, while the flow control apparatus 212 is transitioning from the production-readying configuration to the intermediate closed configuration, the flow controller 222 is disposed in a spaced-apart relationship with the impeder piston 306. In this respect, the flow controller 222, the impeder piston 306, the housing 214, the contractible compartment 308, and the viscous fluid 304 are co-operatively configured such that, during the transitioning of the configuration of the flow control apparatus 212 from the production-readying configuration to the intermediate closed configuration, the flow controller 222 is disposed in a spaced-apart relationship with the impeder piston 306.

In the above description, for purposes of explanation, numerous details are set forth in order to provide a thorough understanding of the present disclosure. However, it will be apparent to one skilled in the art that these specific details are not required in order to practice the present disclosure. Although certain dimensions and materials are described for implementing the disclosed example embodiments, other suitable dimensions and/or materials may be used within the scope of this disclosure. All such modifications and variations, including all suitable current and future changes in technology, are believed to be within the sphere and scope of the present disclosure. All references mentioned are hereby incorporated by reference in their entirety.

The invention claimed is:

1. A wellbore completion component, defining a transition impeder, comprising:

a housing;

a completion component feature defining a completion component passage within the housing, the completion component feature configurable in a first configuration and a second configuration, wherein the transition impeder includes:

a transition-impeding fluid passage; and a fluid disposed for flow within the transition-impeding fluid passage; and an impeder piston, disposed in force communication with a viscous fluid for urging the flow of the viscous fluid through the transition-impeding fluid passage, and displaceable relative to the housing along an axis that is parallel to a central longitudinal axis of the completion component passage, wherein:

the flow of the fluid, through the transition-impeding fluid passage, is effected in response to the transitioning of the completion component feature from the first configuration to the second configuration;

the transition impeder and the completion component feature are co-operatively configured such that resistance to flow, of the fluid through the transition-impeding fluid passage, impedes the transitioning of the completion component feature from the first configuration to the second configuration;

the completion component feature is displaceable relative to the housing along an axis that is parallel to the central longitudinal axis of the completion component passage;

the completion component feature and the impeder piston are configurable in a translatable configuration; and in the translatable configuration, the impeder piston is translatable with the completion component feature, along an axis that is parallel to the central longitudinal axis of the completion component passage, in response to urging of displacement of the completion component feature, relative to the housing, along an axis that is parallel to the central longitudinal axis of the completion component passage, with effect that the viscous fluid is urged to flow through the transition-impeding fluid passage.

2. The wellbore completion component as claimed in claim 1, wherein the transitioning of the completion component feature from the first configuration to the second configuration includes a displacement of the completion component feature relative to the housing.

3. The wellbore completion component as claimed in claim 1, further comprising:

a flow communicator extending through the housing for effecting flow communication between the completion component passage and a space external to the wellbore completion component;

wherein:

the completion component is a flow control apparatus; and the completion component feature includes a flow controller for controlling flow through the flow communicator.

4. The wellbore completion component as claimed in claim 3, wherein the flow controller includes a sliding sleeve.

5. The wellbore completion component as claimed in claim 1, wherein:

the translatable configuration is obtained in response to engagement of the completion component feature with the impeder piston.

6. The wellbore completion component as claimed in claim 1, wherein:

the impeder piston includes an engagement tab;

the completion component feature and the impeder piston are co-operatively disposed in the translatable configuration while the completion component feature is engaged to the engagement tab;

while the completion component feature and the impeder piston are co-operatively disposed in the translatable configuration, in response to urging of displacement of the completion component feature, relative to the housing, along an axis that is parallel to the central longitudinal axis of the completion component passage, the engagement tab is urged to displace outwardly displace relative to an axis that is parallel to the central longitudinal axis of the completion component passage;

the completion component feature, the impeder piston, and the housing are co-operatively configured for disposition in an impeding configuration, wherein, in the impeding configuration, while the completion component feature and the impeder piston are co-operatively disposed in the translatable configuration, and the engagement tab is being urged to displace outwardly relative to an axis that is parallel to the central longitudinal axis of the completion component passage, and while displacement of the completion component feature, relative to the housing, is being urged along an axis that is parallel to the central longitudinal axis of the completion component passage, the housing is interfering with the outwardly displacement of the engagement tab, such that the engagement of the completion component feature to the engagement tab is maintained; and the completion component feature, the impeder piston, and the housing are co-operatively configured for disposition in a non-impeding configuration, wherein, in the non-impeding configuration, while the completion component feature and the impeder piston are co-operatively disposed in the translatable configuration, and the engagement tab is being urged to displace outwardly relative to an axis that is parallel to the central longitudinal axis of the completion component passage, and while displacement of the completion component feature, relative to the housing, is being urged along an axis that is parallel to the central longitudinal axis of the completion component passage, there is an absence of interference, by the housing, to the outwardly displacement of the engagement tab, such that the engagement tab is displaced outwardly relative to an axis that is parallel to the central longitudinal axis of the completion component passage, with effect that the engagement of the completion component passage and the engagement tab is defeated, and with effect that the impeding, by the transition impeder, of the transitioning of the completion component feature from the first configuration to the second configuration, is defeated.

7. The wellbore completion component as claimed in claim 6, wherein:

the completion component feature, the impeder piston, and the housing are further co-operatively configured for transitioning from the impeding configuration to the non-impeding configuration; and the transitioning of the configuration of the completion component feature, the impeder piston, and the housing from the impeding configuration to the non-impeding configuration is effected in response to the displacement of the co-operating unit relative to the housing.

8. The wellbore completion component as claimed in claim 1, wherein:

the impeder piston and the housing are co-operatively configured such that a contractible compartment is defined between the impeder piston and the housing;

at least a portion of the viscous fluid is disposed within the contractible compartment;

the contractible compartment is disposed in flow communication with the transition impeding fluid passage; and the completion component feature, the impeder piston, the housing, the contractible compartment, and the viscous fluid are co-operatively configured such that, during the transitioning of the configuration of the completion component feature, the impeder piston, and the housing from the impeding configuration to the non-impeding configuration, contraction of the contractible compartment is effected, with effect that the impeder piston urges the flow of the viscous fluid, disposed within the contractible compartment, through the transition-impeding fluid passage.

9. The wellbore completion component as claimed in claim 8, wherein:

the transition impeding fluid passage is defined within the impeder piston.

10. The wellbore completion component as claimed in claim 9, wherein:

at least a portion of the transition impeding fluid passage defines a tortuous path.

* * * * *